US005251118A

United States Patent [19]

Budnovitch et al.

[11] Patent Number: 5,251,118

[45] Date of Patent: Oct. 5, 1993

[54] MODULAR LIGHTING SYSTEM AND METHOD

[75] Inventors: William F. Budnovitch, Parkville; Mahendra K. Patel, Weatherby Lake, both of Mo.; Lawrence W. Luciano, Morristown, N.J.

[73] Assignee: Devine Lighting, Inc., North Kansas City, Mo.

[21] Appl. No.: 745,835

[22] Filed: Aug. 16, 1991

[51] Int. Cl.[5] ..... F21V 17/00

[52] U.S. Cl. ..... 362/362; 362/147; 362/432; 362/453; 362/455

[58] Field of Search ..... 362/147, 432, 453, 454, 362/455, 456, 457, 72, 363, 362, 311, 355, 326, 361

[56] References Cited

U.S. PATENT DOCUMENTS

| | | | |
|---|---|---|---|
| 1,499,083 | 6/1924 | Stephens | 362/61 X |
| 1,994,669 | 3/1935 | Schaffner | 362/431 X |
| 2,616,029 | 10/1952 | Osowski | 362/432 X |
| 3,101,908 | 8/1963 | Moore | 362/311 |
| 4,115,845 | 9/1978 | Blahut | 362/431 X |
| 4,489,367 | 12/1984 | Herron et al. | 362/311 |
| 4,635,165 | 1/1987 | Crowley | 362/147 |
| 5,034,869 | 7/1991 | Choi | 362/147 X |

FOREIGN PATENT DOCUMENTS

| | | | |
|---|---|---|---|
| 277438 | 9/1927 | United Kingdom | 362/72 |

*Primary Examiner*—Richard R. Cole

*Attorney, Agent, or Firm*—Litman, McMahon & Brown

[57] ABSTRACT

A modular lighting system includes a line of lighting fixtures with various body, lens, lamping system and mounting system alternative configurations, types and sizes. Many of the lighting system components are interchangeable among the different lighting fixtures. Others of the lighting fixture components can be fabricated by providing a blank with a certain configuration, (e.g., a hemispherical body) and separating it into one or more components forming portions thereof. A method of forming such modular lighting fixtures includes the steps of providing such interchangeable components and providing other components which can be formed from common blanks, mounting such fixtures with various mounting fixtures and lamping such fixtures with various electrical lamping systems.

71 Claims, 12 Drawing Sheets

Fig.4.
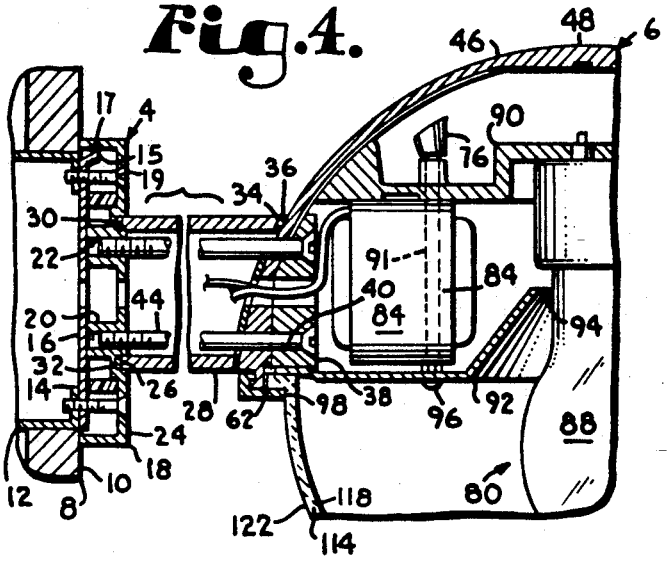
Fig.9.
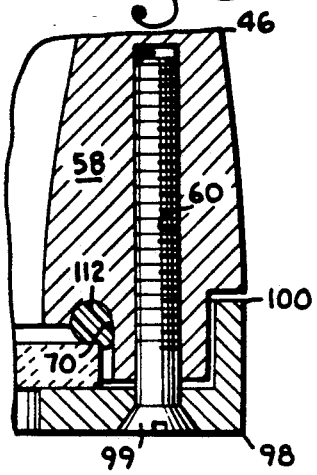
Fig.13.
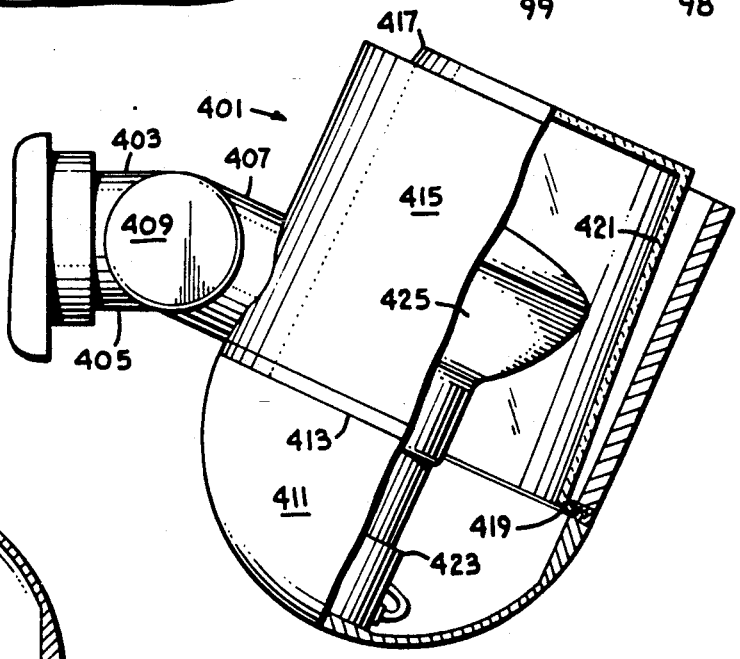
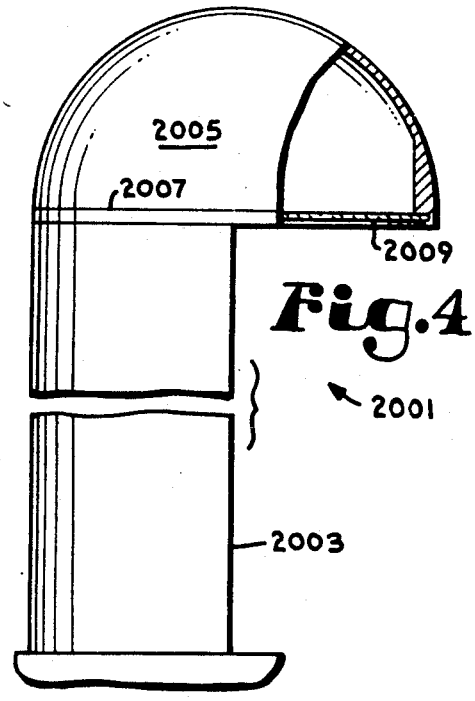
Fig.42.
Fig.11.
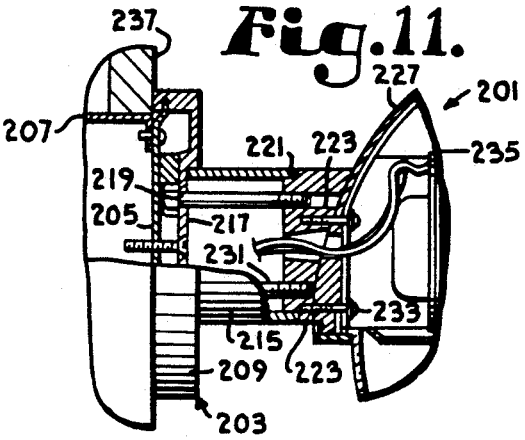

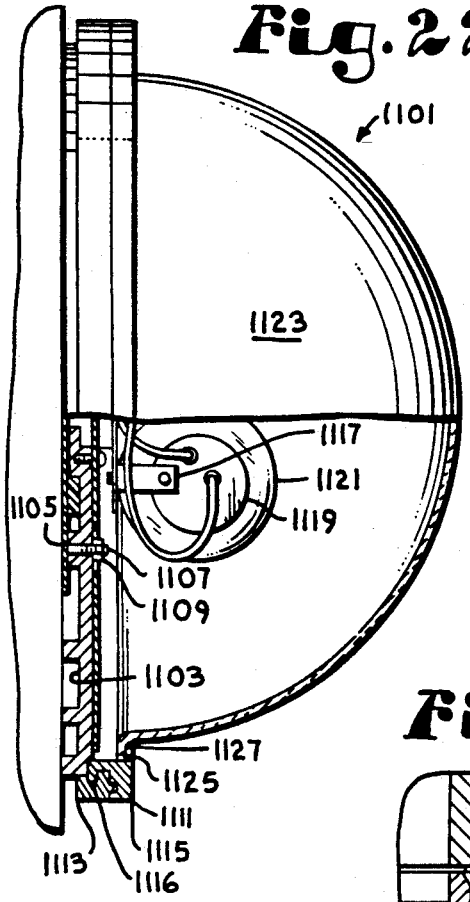
Fig. 22.
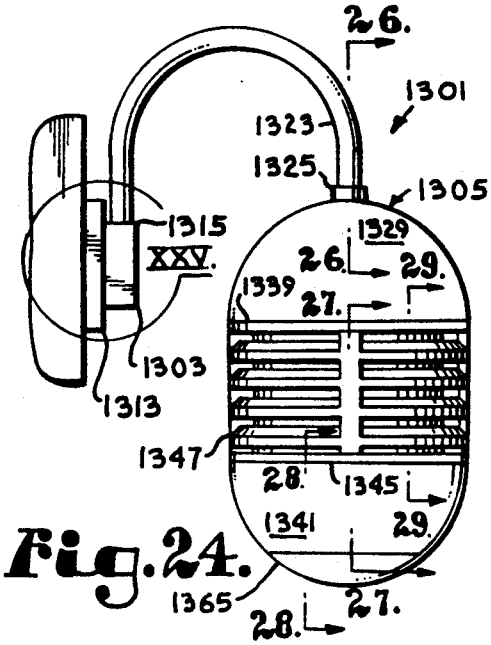
Fig. 24.
Fig. 36.
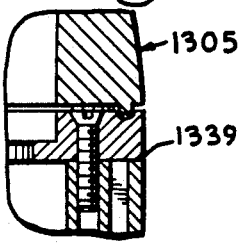
Fig. 25.
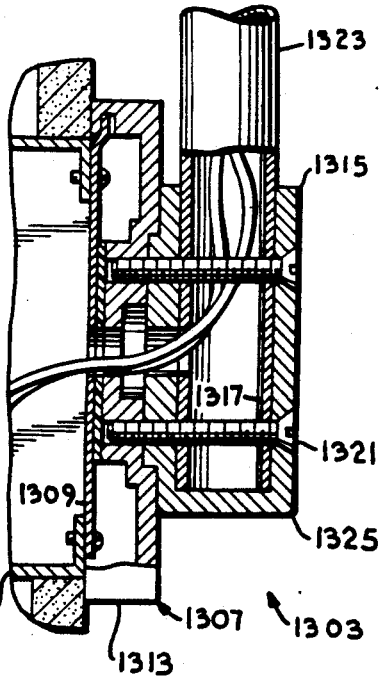
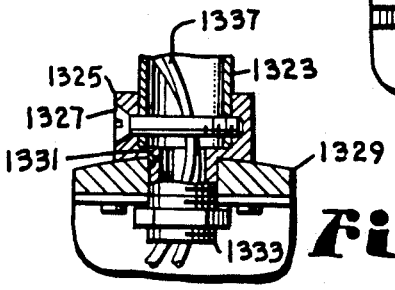
Fig. 26.
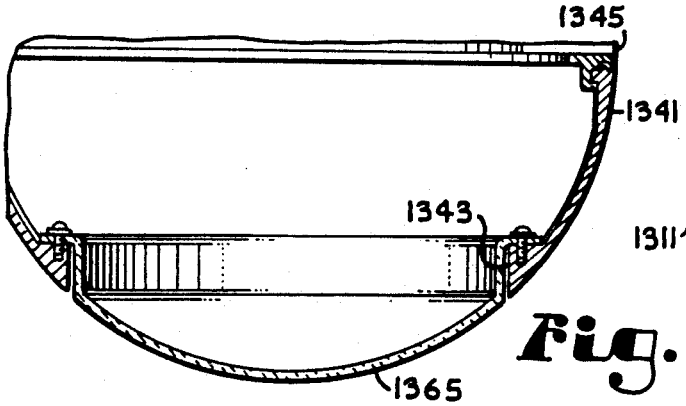
Fig. 28.

Fig.41.
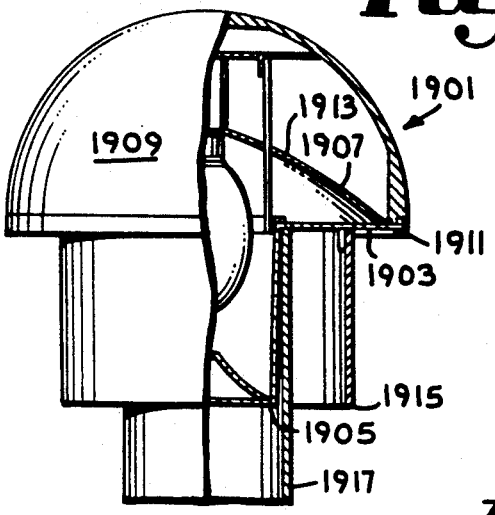
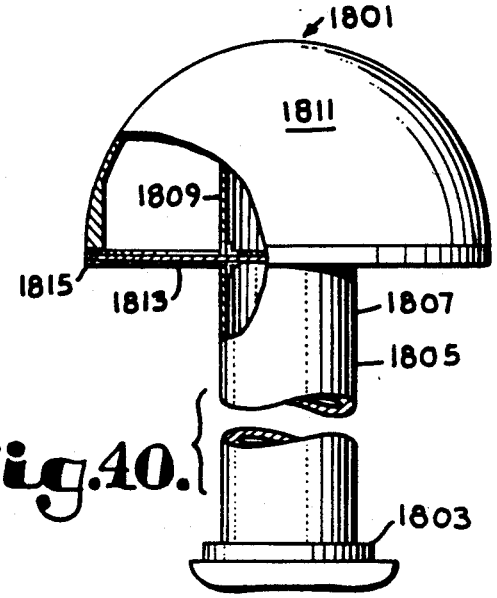
Fig.40.
Fig.33.
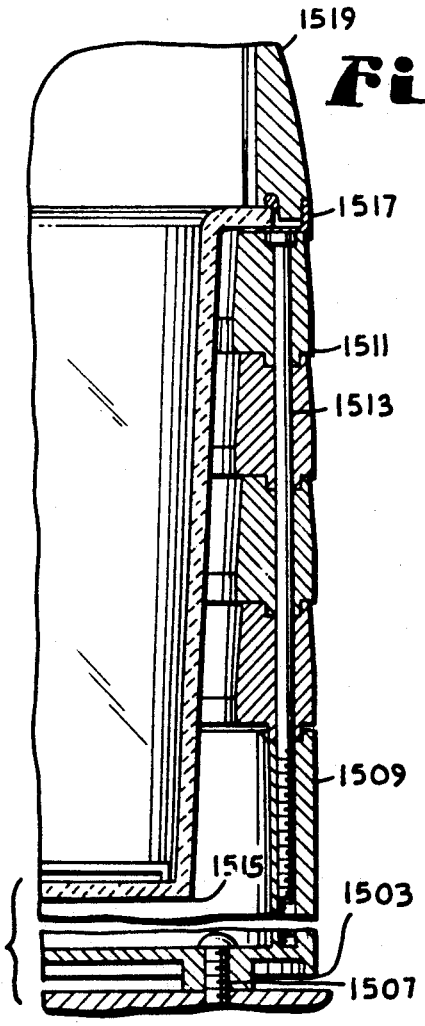
Fig.32.
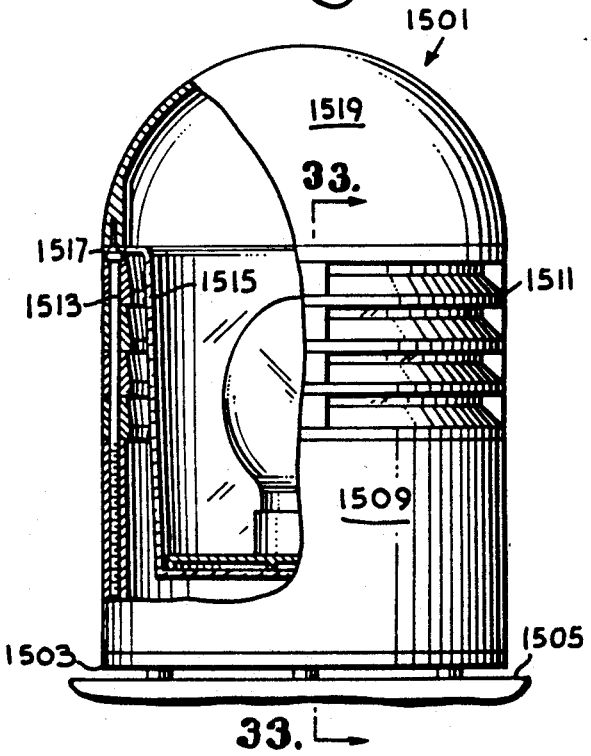

Fig.43.
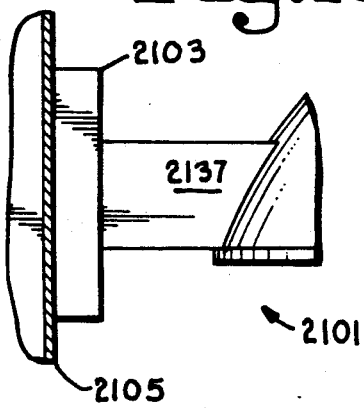
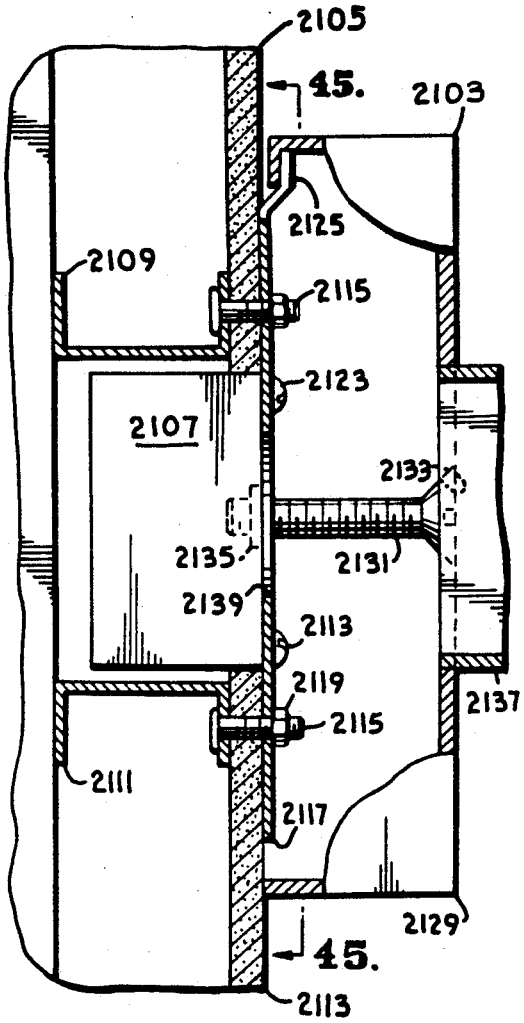
Fig.44.
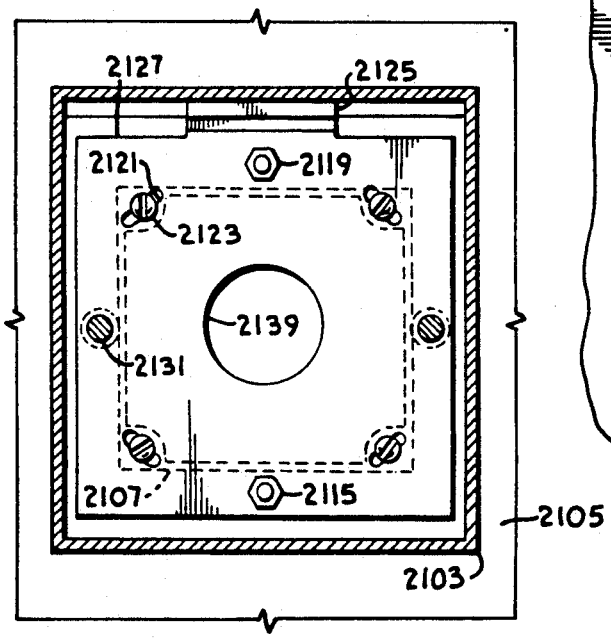
Fig.45.
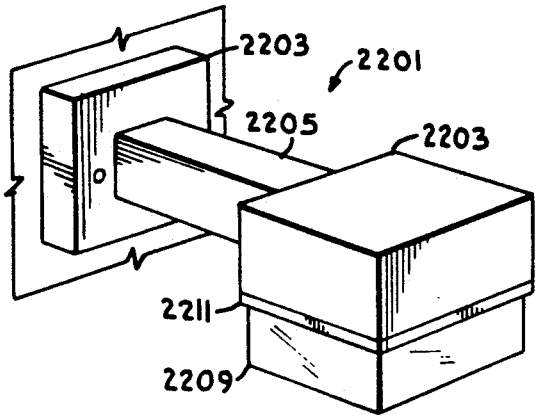
Fig.46.

Fig.47.
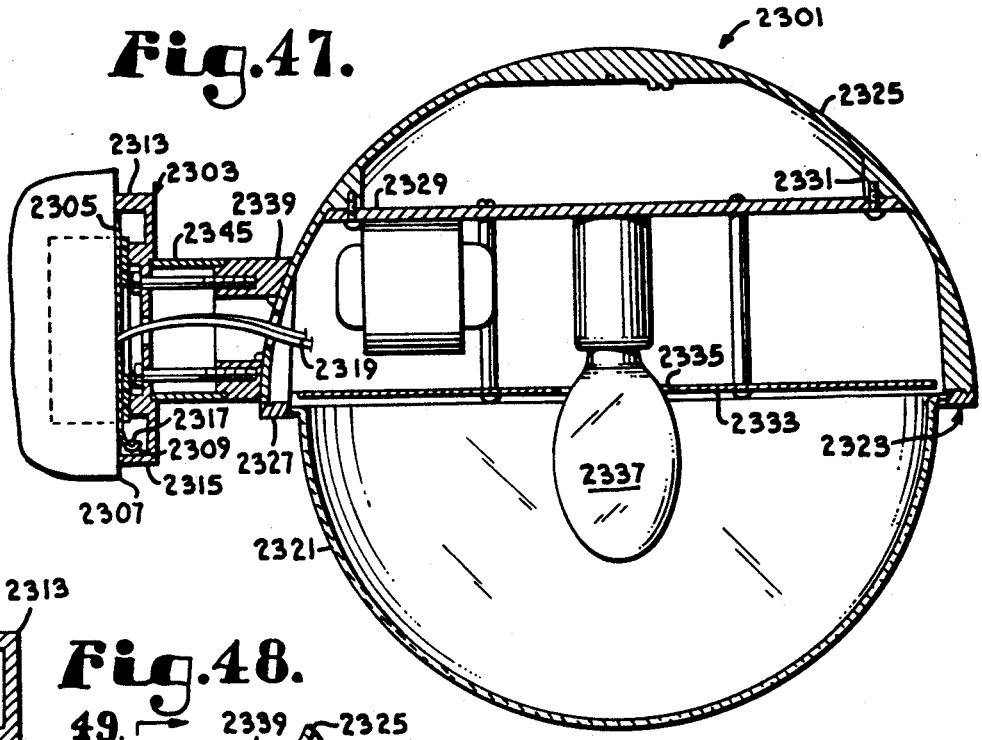
Fig.48.
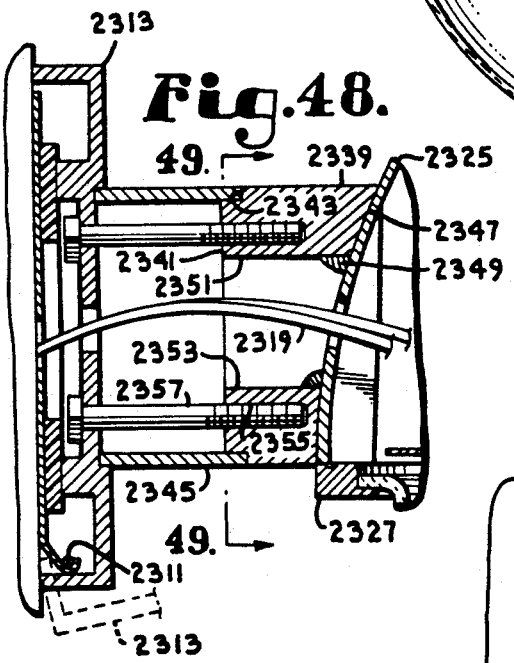
Fig.50.
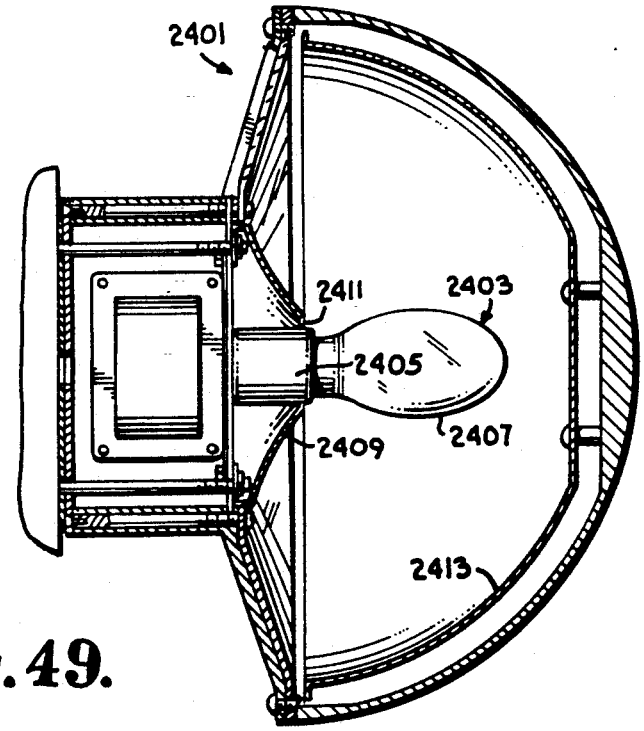
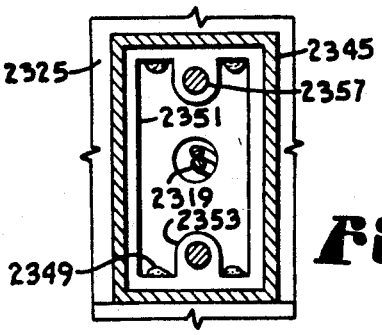
Fig.49.

MODULAR LIGHTING SYSTEM AND METHOD

BACKGROUND OF THE INVENTION

1. Field of the Invention

The present invention relates generally to lighting fixtures, and in particular to a system and method for forming a variety of lighting fixtures from groups of common components.

2. Description of the Related Art

Lighting fixtures are employed in a variety of applications for illuminating, marking, designating and signaling areas, structures and objects. Architectural lighting fixtures can generally be classified as interior and exterior types, with each type having criteria for the particular applications of the lighting fixtures. For example, lighting patterns and illumination levels are often of concern for both types of lighting fixtures. An additional design consideration or criteria for exterior lighting fixtures is weather sealing which can be necessary to protect the lighting fixture components from exposure to precipitation and related problems. Other considerations include aesthetics and the characteristics of the light sources.

A disadvantage with many previous lighting fixtures is that they were designed and adapted for specific applications and provide specific patterns and levels of light output for such specific applications. Therefore, providing a line of lighting fixtures with coordinated appearances can present problems, particularly in costs associated with manufacturing and tooling up for fixtures of various configurations and sizes. Individual projects often involve multiple types of lighting fixtures at various locations throughout. For example, ground-mounted exterior fixtures such as bollards are commonly used to illuminate and mark driveways, parking lots, pedestrian walkways and outdoors areas. The heights of such bollards can vary considerably.

Lighting fixtures are also commonly mounted on buildings and other structures. Such fixtures can be either flush-mounted on walls and ceilings, or can be mounted in spaced relation therefrom. For example, walls are often illuminated by flush-mounted fixtures, and fixtures known as wall washers are commonly employed for this purpose. Area illumination is also often provided by lighting fixtures with extension arm mounting assemblies for spacing them outwardly from wall surfaces. Such fixtures can have extension arms of varying lengths for adaptation to various applications.

Suspended and hanging pendant fixtures are also commonly employed and can be suspended from ceilings and from radius brackets mounted on walls.

Other considerations which effect the design of lighting fixtures include the desired light patterns and levels generated thereby. Thus, various lens configurations have been employed for achieving the desired outputs.

In manufacturing, tooling up for the production of a number of different light fixtures, each having a unique design, can be relatively expensive and time consuming. Furthermore, the costs of stocking such various fixtures and replacement parts therefor can be quite high.

Architectural and landscape lighting fixtures are often constructed with components which are molded, cast, extruded or stamped and often involve a relatively high degree of custom design. The tooling and equipment for such specialized parts can be relatively expensive and considerable efficiency in manufacture could be achieved if some of the components in a complete line of lighting fixtures were interchangeable. Such standardization is present to a certain extent because the electrical system components, such as electrical junction boxes to which lighting fixtures are typically mounted and the internal electrical components are somewhat standardized within the industry.

However, heretofore there has not been available a line of lighting fixtures which can be assembled from certain common, interchangeable parts. Manufacturing a line of lighting fixtures could also be facilitated by casting or molding certain parts in configurations which can be divided into multiple components. For example, a relatively small number of lighting fixture body shapes could be fitted with appropriate lens, lamps and mounting assemblies for adapting them to a variety of lighting applications.

Aesthetics are important considerations in the design of lighting fixtures, particularly in achieving continuity of style among various types of lighting fixtures which may be specified for a particular project. A properly designed line of lighting fixtures can have common stylistic elements and appearance features, even among a relatively wide variety of fixtures for different interior and exterior installations. A line of architectural lighting fixtures preferably enhances the overall appearance of a project by providing such visual continuity, indoors and out. Such visual continuity can be achieved in a line of lighting fixtures by assembling various types of fixtures from common or interchangeable components.

The present invention addresses some or all of the aforementioned considerations in providing a line of lighting fixtures.

SUMMARY OF THE INVENTION

In the practice of the present invention, a modular lighting system is provided which includes a line of lighting fixtures with a variety of mounting systems, bodies, lenses and lamping systems in several sizes each. The lighting fixture components are interchangeable among the different lighting fixtures, and others can be formed from common blanks by cutting them into appropriate sizes and configurations. The fixture bodies are provided with common rim configurations which mate and interlock with common lens mounting rings whereby a lens mounting arrangement is provided which can be utilized in forming a number of the different fixtures. A modular lighting fixture method includes the steps of providing interchangeable lighting fixture components, providing other components which are formed from common blanks, and assembling such components in lighting fixtures of various types and sizes. A number of standard sizes can be provided for satisfying the criteria of a wide variety of lighting fixture applications.

OBJECTS AND ADVANTAGES OF THE INVENTION

The principle objects and advantages of the present invention include: providing a modular lighting system and method; providing such a system which utilizes interchangeable components for providing a line of lighting fixtures; providing such a system which includes a wide variety of lighting fixtures; providing such a system which is adapted for use with various electrical lamping systems; providing such a system which can provide a variety of body configurations; providing such a system which can provide a variety of lens configurations; providing such a system which can provide a variety of mounting configurations; providing such a system with components which can be sized as required for particular applications by scaling up or scaling down various components thereof; providing such a system which utilizes manufacturing and assembly procedures for providing a variety of lighting fixtures from interchangeable components; providing such a system which is efficient in operation, economical in operation and particularly well adapted for the proposed usage thereof; providing a modular lighting method; providing such a method which can be utilized to produce a variety of lighting fixtures from interchangeable components; providing such a method which can produce lighting fixtures sized for various applications by appropriately sizing the components thereof; providing a line of architectural lighting fixtures which provide a continuity of style; providing such a line of lighting fixtures which enhances the aesthetics of objects for which the lighting fixtures are specified; and providing such a method which is economical in operation and well adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a fragmentary, vertical, cross-sectional view thereof taken generally along line 4—4 in FIG. 1.

FIG. 9 is an enlarged, fragmentary, cross-sectional view thereof taken generally along line 9—9 in FIG. 3.

FIG. 11 is an enlarged, fragmentary, cross-sectional view of a wall-mounted, extension, downlight lighting fixture comprising a second modified or alternative embodiment of the present invention with a modified mounting bracket assembly.

FIG. 13 is a side elevational view of a wall-mounted, knuckle bracket lighting fixture With a cylindrical body extension, comprising a fourth modified or alternative embodiment of the present invention.

FIG. **14*a*** is an enlarged, fragmentary, cross-sectional view thereof, particularly showing a modified or alternative lens mounting ring and body rim.

Figure 15A:
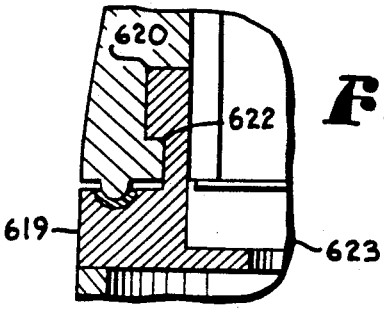
Figure 15:
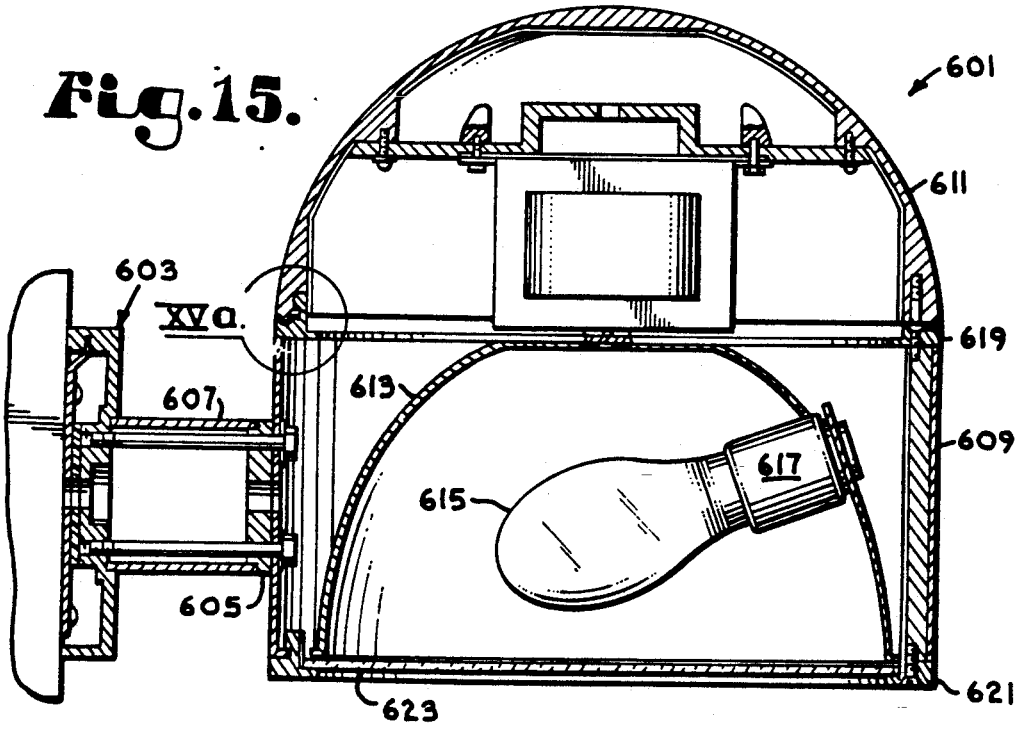

FIG. 15 is a vertical, cross-sectional view of a wall-mounted, extension arm lighting fixture with a cylindrical body extension comprising a sixth modified or alternative embodiment of the present invention.

FIG. **15*a*** is an enlarged, fragmentary, cross-sectional view thereof, particularly showing a lens mounting ring and a body rim thereof.

Figure 16:
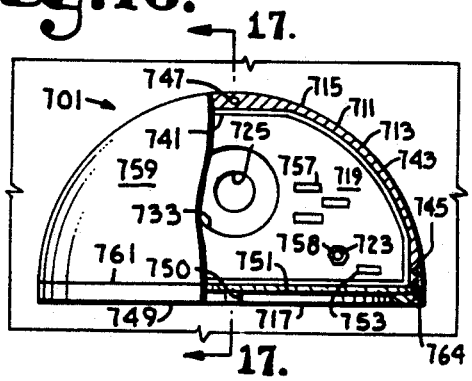

FIG. 16 is a front elevational view of a wall-mounted flush lighting fixture comprising a seventh modified or alternative embodiment of the present invention.

Figure 17:
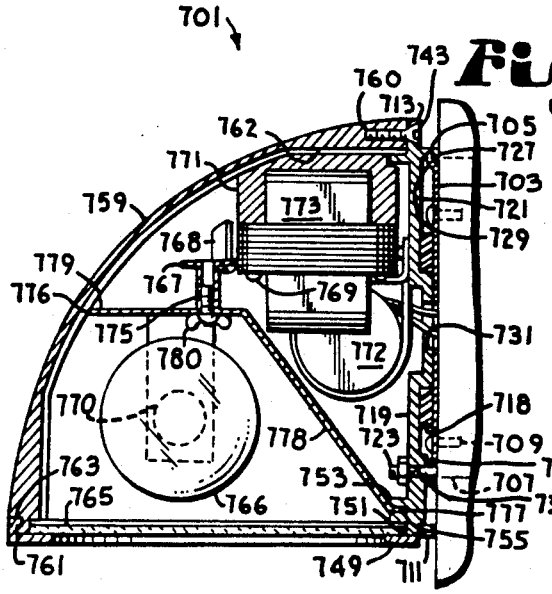

FIG. 17 is an enlarged, vertical cross-sectional view thereof taken generally along line 17—17 in FIG. 16.

Figure 18:
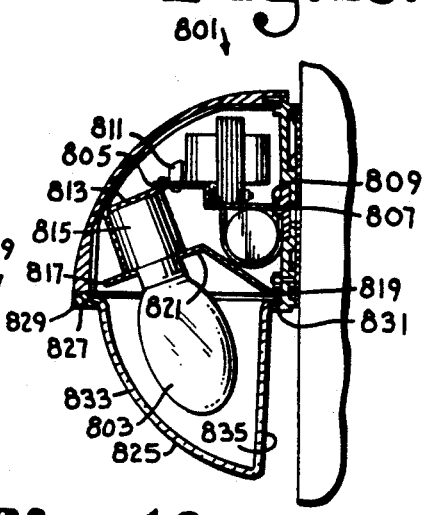

FIG. 18 is a vertical cross-sectional view of a wall-mounted flush lighting fixture with a droop lens, comprising an eighth modified or alternative embodiment of the present invention.

Figure 19:
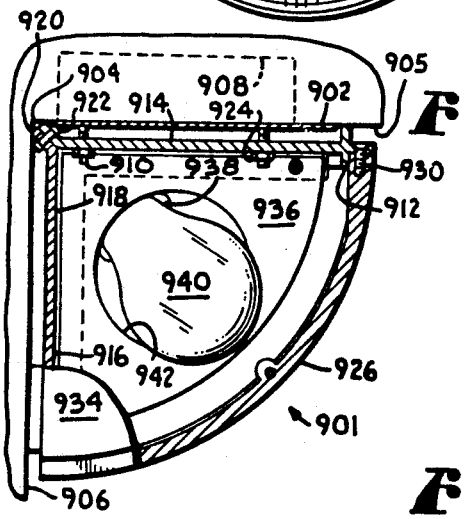

FIG. 19 is a bottom plan view of a wall-mounted flush, quarter-circle, inside corner lighting fixture comprising a ninth modified or alternative embodiment of the present invention.

Figure 20:
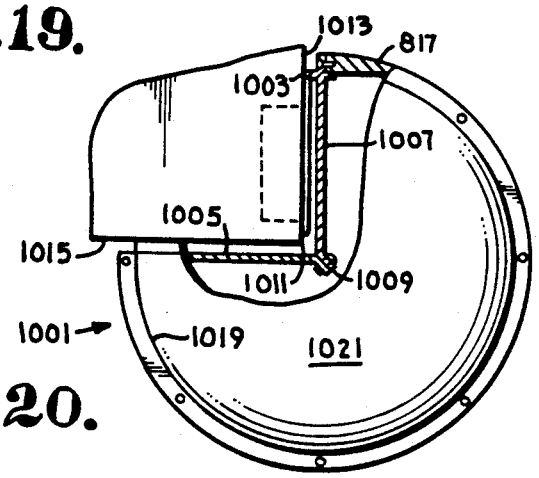

FIG. 20 is a bottom plan view of a wall-mounted, flush, three-quarters circle, outside corner lighting fixture comprising a tenth modified or alternative embodiment of the present invention.

Figure 21:
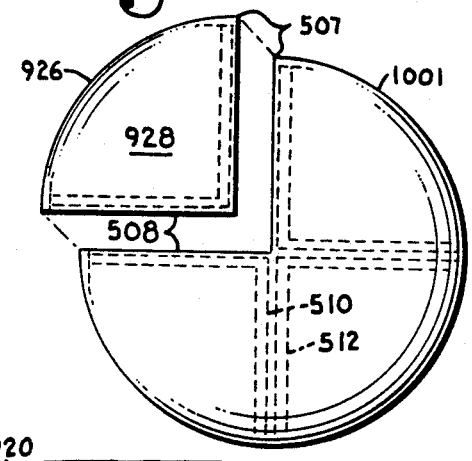

FIG. 21 is a top plan view of a body blank, showing a quarter section (comprising one-eighth of a sphere) being removed therefrom.

FIG. 22 is a side elevational view of a wall-mounted flush full lens lighting fixture comprising an eleventh modified or alternative embodiment of the present invention.

Figure 23:
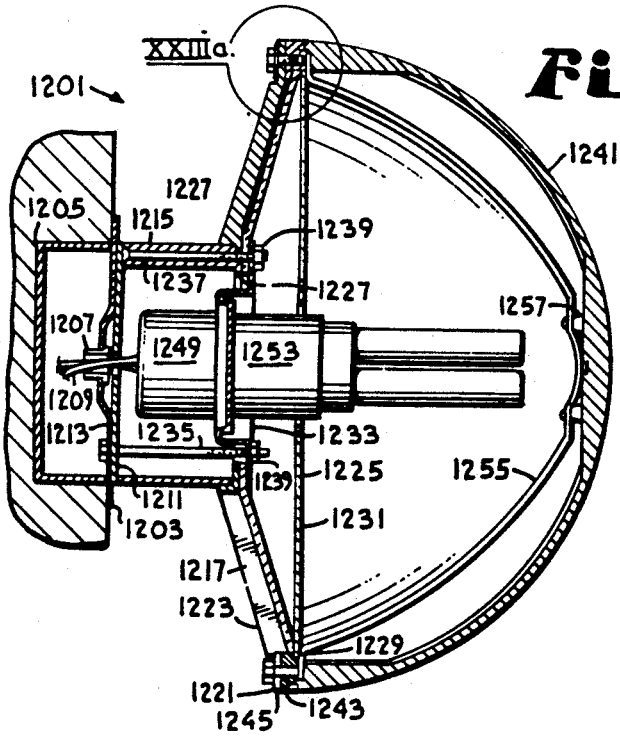
Figure 23A:
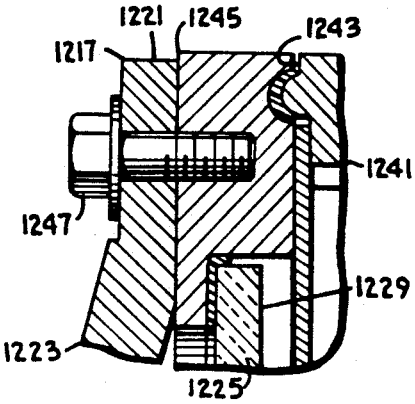

FIG. 23 is a vertical cross-sectional view of a wall-mounted indirect lighting fixture comprising a twelfth modified or alternative embodiment of the present invention.

FIG. **23*a*** is an enlarged, fragmentary, cross-sectional view thereof.

FIG. 24 is a side elevational view of a wall-mounted, radius bracket or gooseneck arm lighting fixture with a louvered body and a downwardly directed spotlight comprising a thirteenth modified or alternative embodiment of the present invention.

FIG. 25 is an enlarged, fragmentary, cross-sectional view thereof.

FIG. 26 is an enlarged, fragmentary, cross-sectional view thereof, taken generally along line 26—26 in FIG. 24.

Figure 27:
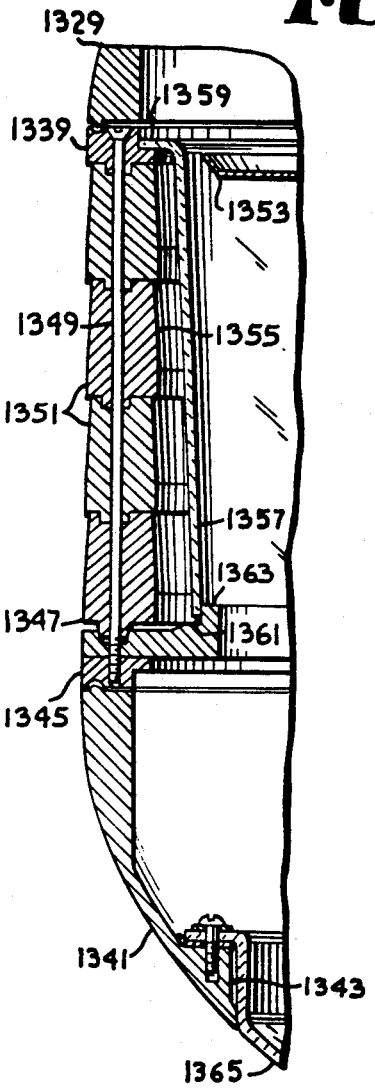

FIG. 27 is an enlarged, fragmentary, cross-sectional view thereof, taken generally along line 27—27 in FIG. 24.

FIG. 28 is an enlarged, fragmentary, cross-sectional view thereof, taken generally along line 28—28 in FIG. 24.

Figure 29:
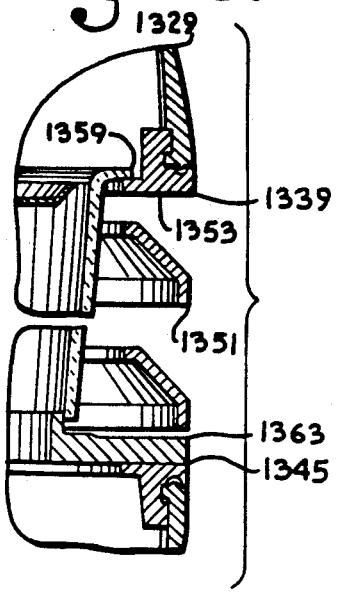

FIG. 29 is an enlarged, fragmentary, cross-sectional view thereof, taken generally along line 29—29 in FIG. 24.

Figure 31:
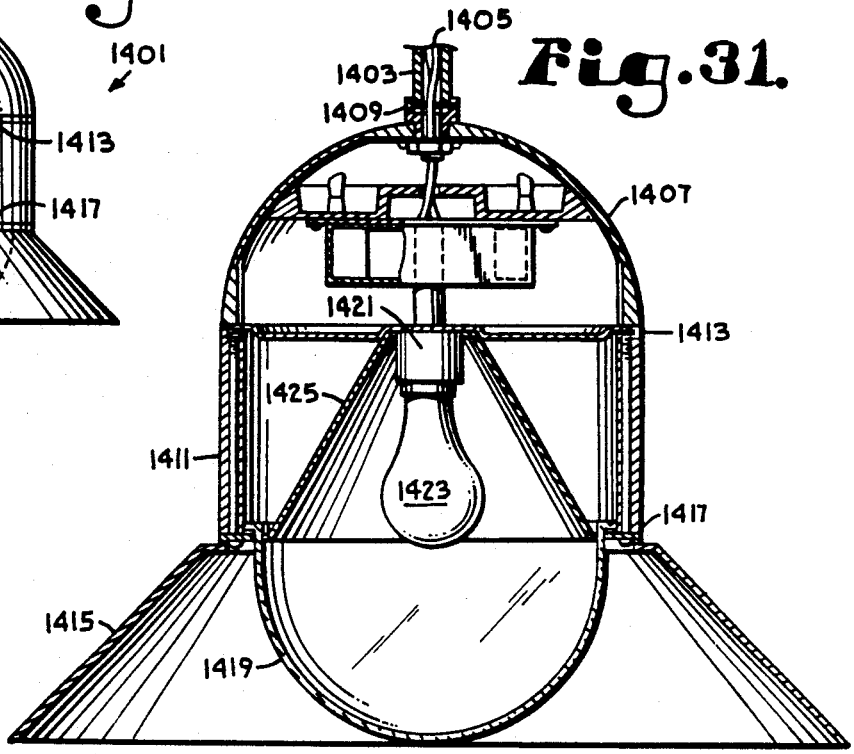

FIG. 31 is a fragmentary, side elevational view of a hanging pendant lighting fixture with a skirt comprising a fourteenth modified or alternative embodiment of the present invention.

FIG. 32 is an enlarged, vertical cross-sectional view thereof taken generally along line 32—32 in FIG. 31.

FIG. 33 is a side elevational view of a bollard, louvered lighting fixture comprising a fifteenth modified or alternative embodiment of the present invention.

Figure 34:
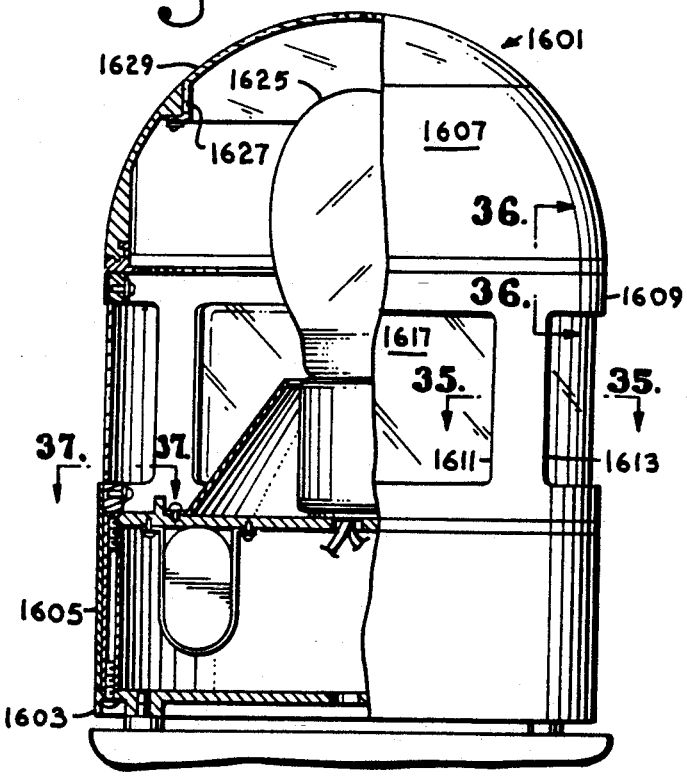

FIG. 34 is an enlarged, fragmentary, cross-sectional view thereof.

Figure 35:
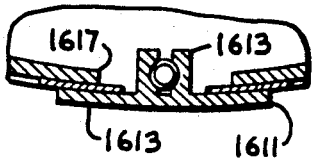

FIG. 35 is a side elevational view of a bollard lighting fixture with side lights and a top spotlight comprising a sixteenth modified or alternative embodiment of the present invention.

FIG. 36 is an enlarged, fragmentary, cross-sectional view thereof taken generally along line 36–36 in FIG. 35.

Figure 30:
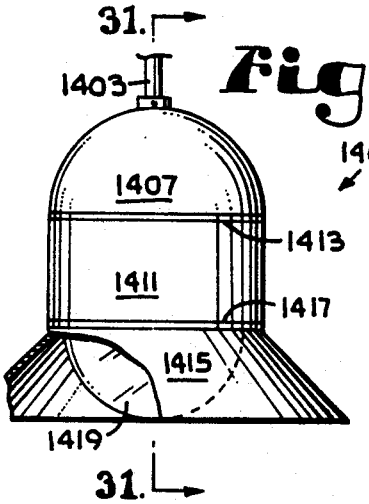

FIG. 30 is an enlarged, fragmentary, cross-sectional view thereof taken generally along line 30—30 in FIG. 35.

Figure 37:
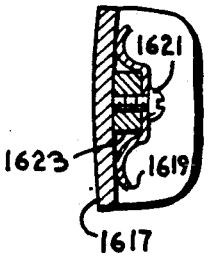

FIG. 37 is a side elevational view of a column-mounted bollard with a full lens comprising a seventeenth modified or alternative embodiment of the present invention.

Figure 38:
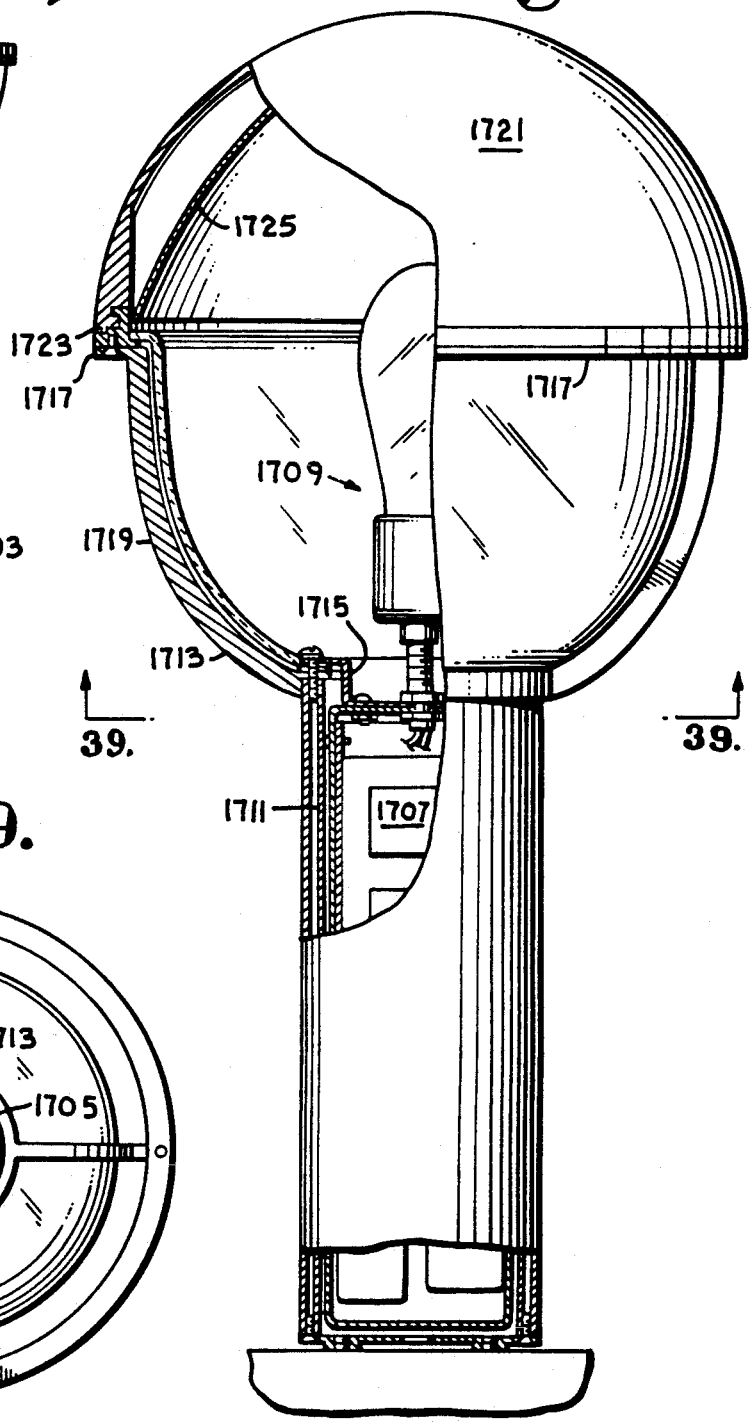

FIG. 38 is an enlarged, side elevational view thereof, with portions broken away to reveal internal construction.

Figure 39:
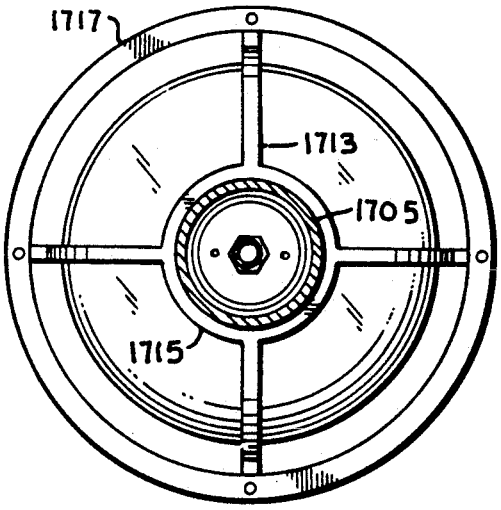

FIG. 39 is a horizontal, cross-sectional view thereof taken generally along line 39—39 in FIG. 38.

FIG. 40 is a side elevational view of a column-mounted bollard with a flat lens comprising an eighteenth modified or alternative embodiment of the present invention.

FIG. 41 is a fragmentary, side elevational view of a column-mounted bollard lighting fixture with a lens skirt comprising a nineteenth modified or alternative embodiment of the present invention.

FIG. 42 is a side elevational view of a bollard with a half cylinder base comprising a twentieth modified or alternative embodiment of the present invention.

FIG. 43 is a fragmentary, side elevational view of an extension arm, downlight lighting fixture comprising a twenty-first modified or alternative embodiment of the present invention.

FIG. 44 is an enlarged, fragmentary, vertical cross-sectional view thereof, particularly showing a wall-mounting system thereof.

FIG. 45 is an enlarged, vertical, cross-sectional view thereof taken generally along line 45—45 in FIG. 44.

FIG. 46 is a top, front, left side perspective view of a wall-mounted extension arm, downlight, square body lighting fixture comprising a twenty-second modified or alternative embodiment of the present invention.

FIG. 47 is a vertical, cross-sectional view of a wall-mounted, extension arm, downlight lighting fixture comprising a twenty-third modified or alternative embodiment of the present invention.

FIG. 48 is an enlarged, fragmentary, vertical, cross-sectional view thereof, particularly showing a body mounting bracket thereof.

FIG. 49 is an enlarged, fragmentary, vertical, cross-sectional view thereof, taken generally along line 49—49 in FIG. 48.

FIG. 50 is a vertical, cross-sectional view of a wall-mounted, wall washer lighting fixture comprising a twenty-fourth modified or alternative embodiment of the present invention.

Figure 51:
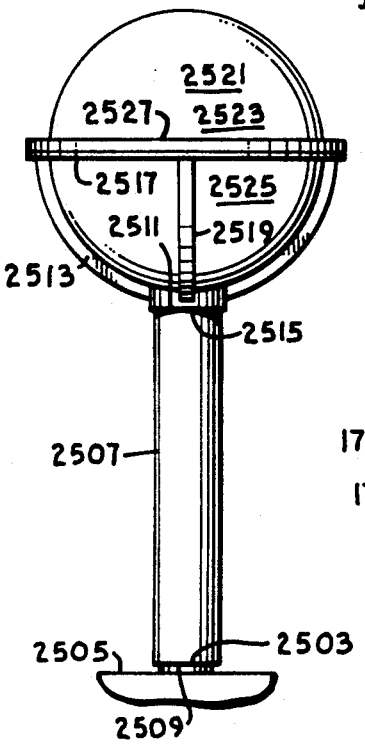

FIG. 51 is a side elevational view of a post-mounted, spherical lens fixture comprising a twenty-fifth modified or alternative embodiment of the present invention.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

The reference numeral 2 generally designates a wall-mounted, extension arm, downlight lighting fixture embodying the present invention. The lighting fixture 2 generally comprises a mounting bracket assembly 4 and a luminaire assembly 6.

II. Mounting Bracket Assembly

The mounting bracket assembly 4 is adapted for mounting the fixture 2 on a wall structure 8 including an exterior surface 10. An electrical junction box 12, is embedded in the wall structure 8 and is substantially flush with the wall exterior surface 10. The junction box 12 includes female-threaded receiver ears 14, which can be positioned at four corners of a substantially square mounting screw pattern. The electrical junction box 12 can receive wires connected to a source of electrical power, such as the electrical system of a building or other structure. The junction box 12 can be a cast junction box with sufficient structural strength to support the lighting fixture 2, and can have a nominal dimension of, e.g., four inches.

A mounting plate 16 with an upper mounting tab 17 is placed over the junction box 12 and a mounting cover 18, which can comprise cast metal, is placed over the mounting plate 16. A slot 15 on the inside of the mounting cover 18 receives the mounting tab 17 for suspending the fixture 2 until flat head, countersunk cover-to-plate-to-box mounting screws 19 are installed through the cover 18, the mounting plate 16 and into the junction box ears 14. The mounting cover 18 includes mounting screw bosses 20 with mounting cover threaded receivers 22 open at an outer face 24 of the mounting cover 18. The mounting cover 18 includes a concentric, relatively shallow annular groove 26.

A mounting arm 28 can comprise, for example, extruded aluminum, and includes an inner end 30 received in the mounting cover groove 26 with an inner mounting arm gasket 32 therebetween and an outer end 34 with an outer mounting arm gasket 36 and a generally elliptical curved configuration for matching the configuration of an outer surface of the luminaire assembly 6. A mounting backplate 38 is placed within the luminaire assembly 6 and includes backplate screw receivers 40, which can be countersunk.

The cover-to-plate-to-box mounting screws 19 can have round, oval or countersunk heads as preferred for a particular appearance. Luminaire mounting screws 44 extend through the mounting backplate 38 and the mounting arm 28 and are threadably received in the mounting cover receivers 22. The luminaire mounting screws 44 are shown with flush, countersunk heads.

III. Luminaire Assembly 6

The luminaire assembly 6 includes a body 46 with an outer surface 48 having the general configuration of one-half of a sphere. The body 46 forms a body interior 50 and includes a body rim 52 with a generally circular configuration. The body 46 is bisected by a pair of channels 53 which intersect at substantially right angles at a channel intersection 55 at a top center of the body 46. The channels 53 are open to the body interior 50 at an inner surface 49 thereof. The channels 53 are flanked by thickened strips 57 and each channel 53 extends between diametrically opposite locations in proximity to the rim 52.

The rim 52 has a generally circular outer perimeter 54 and an inner perimeter 56. A plurality of rim or outer screw bosses 58 with threaded receivers 60 are located at the body rim inner perimeter 56. For example, four rim or outer screw bosses 58 are shown at intervals of approximately 90 degrees. The rim screw bosses 58 project slightly outwardly from the rim 52 (FIG. 9).

A plurality of lens mounting lugs 62 project outwardly from the rim 52. For example, four body locking lugs 62 are shown positioned at radial intervals of approximately 90 degrees around the rim 52, with the locking lugs 62 being positioned approximately halfway radially between the respective rim screw bosses 58. Each locking lug 62 includes a proximate leg 64 which has an orientation which is substantially normal with respect to the rim 52 and a distal leg 66 which projects radially outwardly from the proximate leg 64 in a direction substantially parallel to the rim 52 whereby a channel 68 is formed which is open outwardly at the body outer surface 48.

A gasket groove 70 is formed in the rim 52 adjacent to and substantially parallel with the rim inner perimeter 56.

The body 46 includes a set of inner screw bosses 72 projecting into the body interior 50 with threaded receivers 74 and a set of intermediate screw bosses 76 which project inwardly into the body interior 50 and include threaded receivers 78. The inner and intermediate screw bosses 72, 76 form respective patterns of four each generally positioned at the corners of respective square screw patterns, with the pattern of the inner screw bosses 72 being the smallest, the rim screw boss 58 pattern being the largest, and the intermediate screw boss pattern 76 being intermediate in size with respect thereto.

Figure 3:
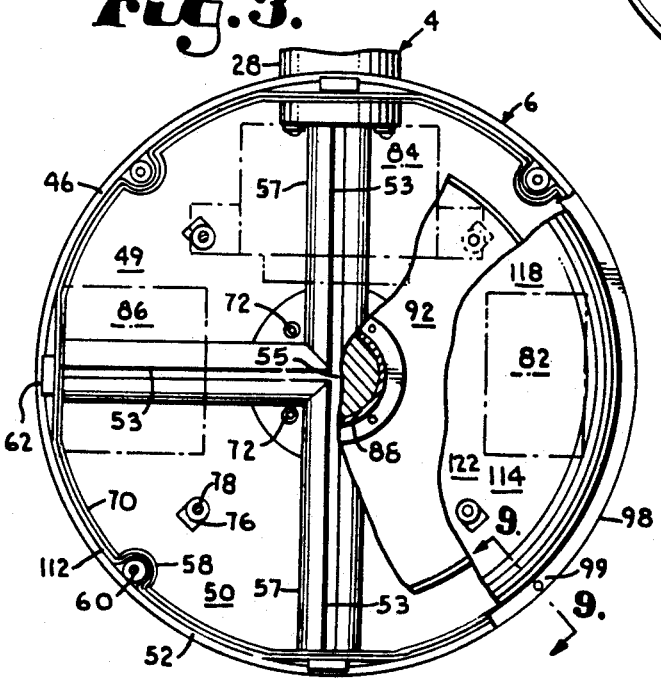
FIG. 3 is a horizontal cross-sectional view thereof taken generally along line 3—3 in FIG. 2.
Figure 6:
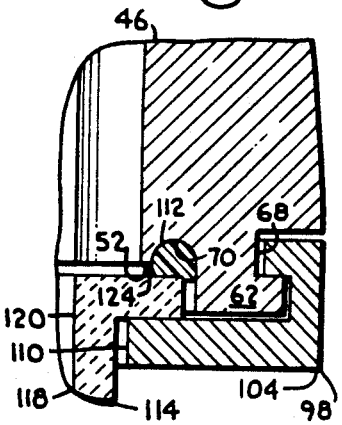
FIG. 6 is an enlarged, fragmentary, cross-sectional view thereof, taken generally along line 6—6 in FIG. 2.

An illumination source 80 is mounted generally within the body interior 50. Various illumination sources are suitable for use with the lighting fixture 2, for example, incandescent, fluorescent, (including compact fluorescent), metal halide and high pressure sodium. The appropriate illumination source 80 can be selected on the basis of illumination output requirements, desired energy efficiency rating, bulb life, light output spectral qualities, cost, etc. FIG. 3 shows the approximate locations for an ignitor 82, a ballast 84, a capacitor 86 and a lamp 88, all of which can be mounted on the body 46 by means of a heat sink 90 attached to the intermediate screw bosses 76.

A generally circular reflector 92, which can comprise, for example, polished aluminum, is positioned over the body interior 50 and is approximately coplanar with the rim 52. The reflector 92 includes a central, funnel-shaped opening 94 which receives the lamp 88. The reflector 92 can be attached to the heat sink 90 by reflector-to-heat sink mounting screws 96 extending through stand-off spacers 91. The reflector 92 can assume a variety of configurations corresponding to the desired output characteristics of the light fixture 2. The reflector 92 can be substantially flat and can hide various internal components (e.g., the ignitor 82, the ballast 84 and the capacitor 86) from view whereby such electrical components are concealed from the outside of the lighting fixture 2.

Figure 1:
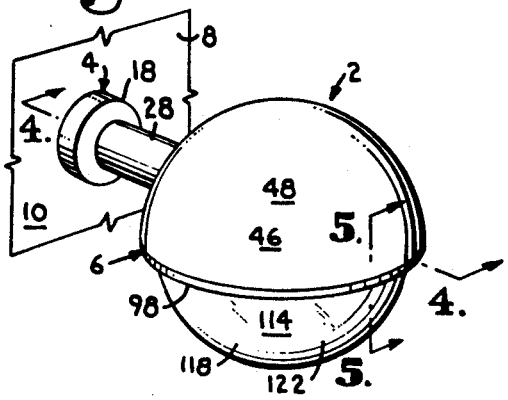
FIG. 1 is a top, front left side perspective view of a wall-mounted extension arm, downlight lighting fixture embodying the present invention.
Figure 5:
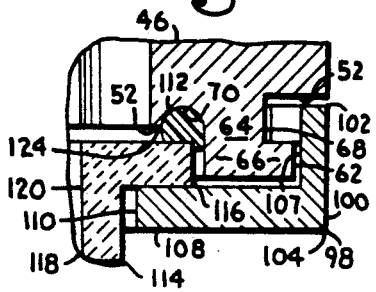
FIG. 5 is an enlarged, fragmentary, cross-sectional view thereof, taken generally along line 5—5 in FIG. 1.
Figure 2:
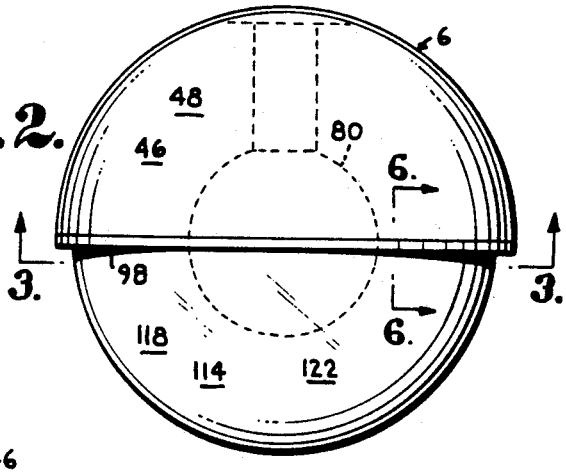
FIG. 2 is a front elevational view thereof.

A lens mounting ring or frame 98 includes a perimeter flange 100 with a cylindrical configuration for placement substantially flush with the body outer surface 48. The perimeter flange 100 includes an inner margin 102 positioned adjacent to the rim 52 and an outer margin 104. A plurality (e.g., 4 at 90 degree radial intervals) of ring locking lugs 106 project radially inwardly from the inner margin 102 for receipt in the lens locking lug channels 68 and form ring lug channels 107 (FIG. 5). An annular face flange 108 extends radially inwardly from the outer margin 104 and forms a circular lens opening 110.

The lens mounting ring face flange 108 includes corresponding lens mounting ring receivers 97 which can align with the outer screw boss receivers 60 when the lens mounting ring 98 is properly positioned on the body rim 52.

An elastomeric O-ring 112 is placed on the body rim 52 partly within the O-ring groove 70.

The luminaire 44 includes a lens 114 with a perimeter lens flange 116 having an annular configuration, a frusto-spherical (e.g., hemispherical) main portion 118, an inner surface 120 and an outer surface 122. As shown in FIGS. 4, 5, 6 and 9, the lens flange 116 can be captured between the body rim 52 and the lens mounting ring flange 100, with the O-ring 112 forming a weather seal in a slight gap 124 between the body rim 52 and the lens flange 116.

The lens mounting ring 98 and the lens 114 are retained in place by the locking engagement of the lens locking lugs 62 and the ring locking lugs 106, which are adapted to lockingly engage when the lens mounting ring 98 is placed against the body rim 52 and twisted to engage the locking lugs 62, 106. With the lens mounting ring 98 properly positioned on the body rim 52, the receivers 95, 97 are aligned for receiving the screws 99 whereby the lens mounting ring 98 can be fixedly mounted on the body 46 for retaining the lens 114 in place.

IV. First Modified or Alternative Embodiment Lighting Fixture 101

Figure 10:
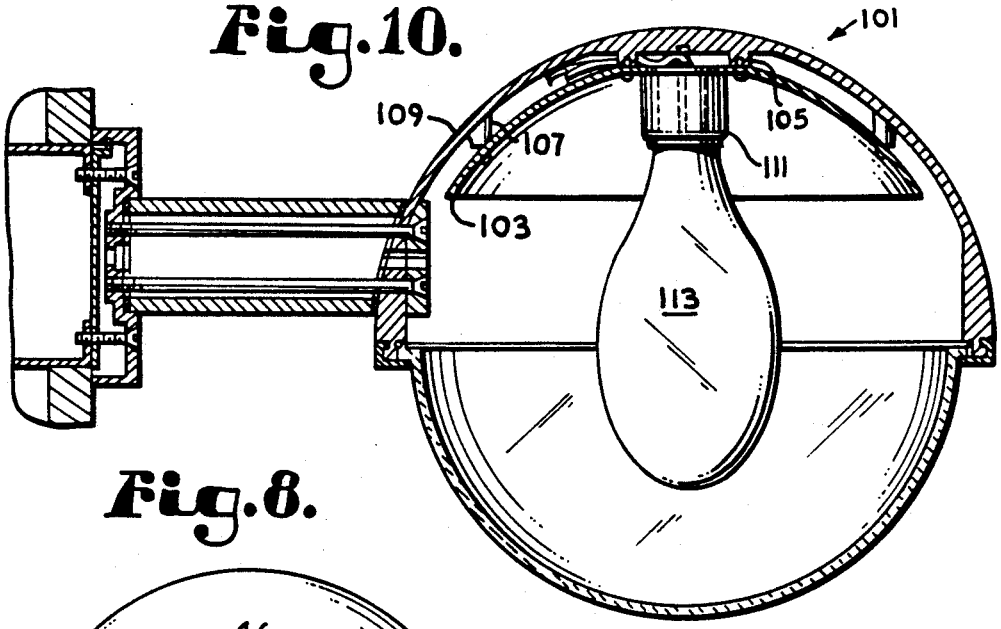
FIG. 10 is a vertical cross-sectional view of a wall-mounted, extension arm, downlight lighting fixture comprising a first modified or alternative embodiment of the present invention with an incandescent lamp.
Figure 8:
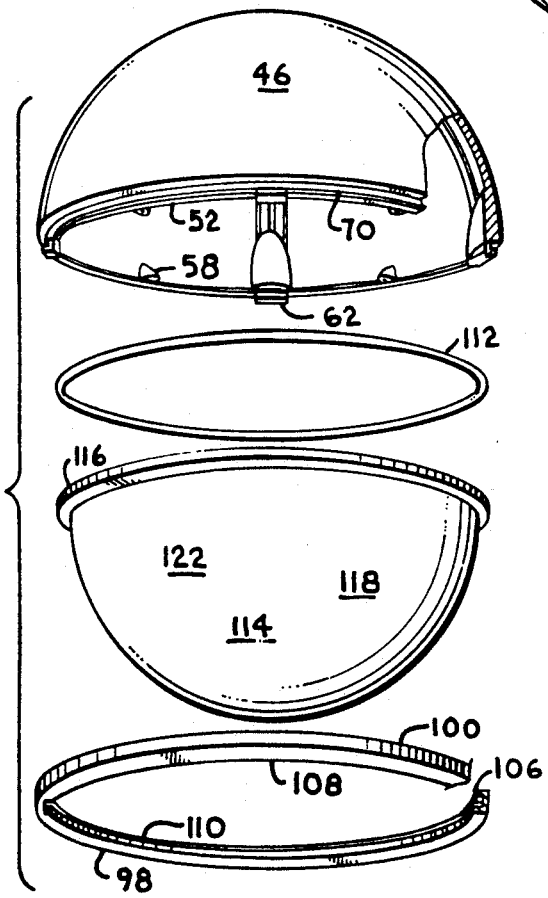
FIG. 8 is a fragmentary exploded view thereof.

A wall-mounted, extension arm, downlight lighting fixture 101 is shown in FIG. 10 and comprises a first modified or alternative embodiment of the present invention. The lighting fixture 101 includes an upwardly-concave, polished metal reflector 103 attached to inner and intermediate screw bosses 105, 107 formed in a body 109, which can be substantially identical to the luminaire body 46 described above. A female-threaded electrical socket 111 is mounted on the reflector 103 and threadably receives an incandescent lamp 113.

Other than the reflector 103, the socket 111 and the lamp 113, and components related thereto, the components of the lighting fixture 101 can be substantially to, and interchangeable with, the components of the lighting fixture 2. By employing components which are common to an interchangeable with a number of lighting fixtures, various lighting options can be offered with relatively few special or customized components.

V. Second Modified or Alternative Embodiment Lighting Fixture 201

A lighting fixture 201 comprising a second modified or alternative embodiment of the present invention is shown in FIG. 11 and includes a mounting bracket assembly 203 with a mounting plate 205 attached to a junction box 207 and mounting a mounting cover 209. Plate-to-box mounting screws 211 attach the plate 205 to the junction box 207, and a pair of countersunk cover-to-plate screws 213 mount the cover 209 to the plate 205, and can be positioned on either side of a mounting arm 215. The cover includes a concentric, circular, central recess 217 with cover bolt receivers 219. An annular cover-to-plate gasket (not shown) is compressed between the cover 209 and the plate 205 to form a weathertight seal therebetween.

The mounting arm 215 includes an outer end 223 received in a shoulder 221 of an adapter block 223 with an outer end 225 contoured to generally conform to a luminaire body 227 and a pair of threaded receivers 229. A pair of cover-to-adapter mounting bolts 231 extend through the cover bolt receivers 219 and are threadably received in the adapter receivers 229.

Body-to-adapter screws 233 extend through the body 227 and are threadably received in the adapter block 223. With the construction of the mounting arm 215 as described above, the mounting arm 215 can assume various lengths with appropriately sized bolts 231 for varying the spacing of a luminaire assembly 235 from a wall surface 237. For example, mounting arms such as 215 can be supplied in various lengths and can be cut to size for particular applications.

VI. Third Modified or Alternative Embodiment Lighting Fixture 301

Figure 12:
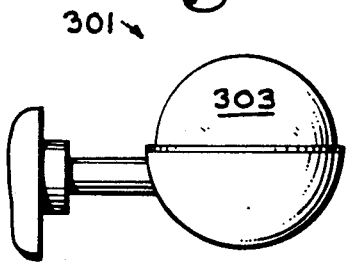
FIG. 12 is a side elevational view of a wall-mounted, extension arm, uplight lighting fixture comprising a third modified or alternative embodiment of the present invention.
Figure 7:
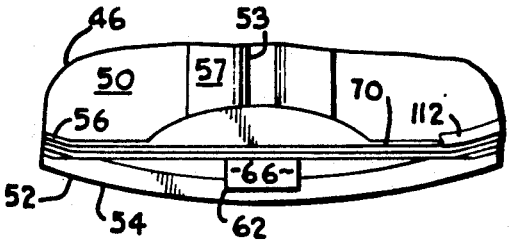
FIG. 7 is an enlarged, fragmentary, bottom plan view thereof, particularly showing a body rim.

FIG. 12 shows a wall-mounted, extension arm uplight lighting fixture 301 comprising a third modified or alternative embodiment of the present invention. The light fixture 301 is similar to the light fixture 201, except that a lens 303 thereof is oriented upwardly. The components of the lighting fixtures 2, 101, 201 and 301 could be assembled in other configurations for orienting their lenses laterally in either direction and at various other orientations.

VII. Fourth Modified or Alternative Embodiment Lighting Fixture 401

A wall-mounted, knuckle bracket lighting fixture comprising a fourth modified or alternative embodiment of the present invention is shown in FIG. 13 and is generally designated by the reference numeral 401. The lighting fixture 401 includes an extension arm assembly 403 with a proximate section 405 and a distal section 407 pivotally interconnected by a knuckle bracket 409 about a horizontal pivotal axis.

The lighting fixture 401 includes a body 411, which can be substantially similar to the body 46 described above, and a lens mounting ring 413, which can be substantially similar to the lens mounting ring 98 described above. A cylindrical body extension 415 is mounted on the lens mounting ring 413 and partially encloses a lens 417 with an annular flange 419 connected to the lens mounting ring 413 and a frusto-conical or tapered cylindrical lens body 421.

A socket 423 is mounted on the body 411 and threadably receives a lamp 425, which can comprise, for example, an incandescent flood light. The extension arm assembly distal section 407 is mounted on the body extension 415. The lighting fixture 401 can be directed either upwardly or downwardly.

VIII. Fifth Modified or Alternative Embodiment Lighting Fixture 501

Figure 14:
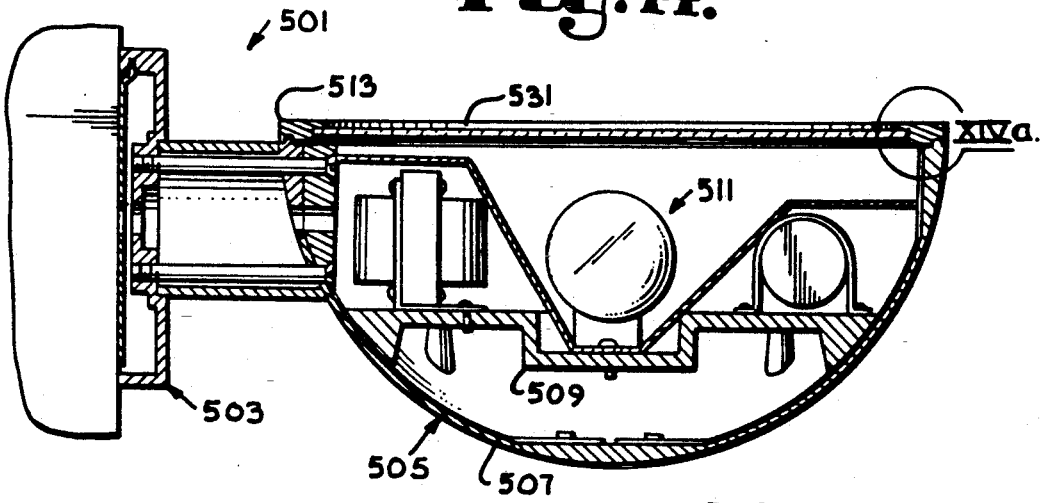
FIG. 14 is a vertical cross-sectional view of a wall-mounted, extension arm, uplight lighting fixture with a flat lens, comprising a fifth modified or alternative embodiment of the present invention.
Figure 14A:
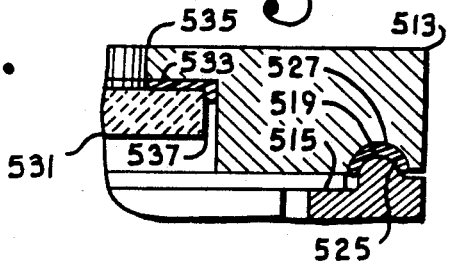

A wall-mounted, extension arm, uplight lighting fixture comprising a fifth modified or alternative embodiment of the present invention is shown in FIGS. 14 and **14*a* and is generally designated by the reference numeral 501. The lighting fixture 501 includes a mounting bracket assembly 503 which can be substantially similar to the mounting bracket assembly described above and a luminaire assembly 505 with a heat sink 509 and lighting components 511 substantially similar to those described above The lighting fixture 501 is oriented with its body 507 opening upwardly and includes a modified lens mounting ring 513 and a modified body rim 515. The body rim 515 includes a plurality of body rim lugs 517 which extend inwardly and a body rim bead 519 which projects slightly outwardly from a body rim face 521** and has an arcuate, outwardly-convex configuration.

The lens mounting ring 513 includes an annular groove 525 which receives an O-ring 527 which is compressed in a weathertight seal by the bead 519. A flat circular lens 531 is mounted on the lens mounting ring 513 by a layer of adhesive 533 between a lens perimeter and a ring flange 513.

IX. Sixth Modified or Alternative Embodiment Lighting Fixture 601

A wall-mounted, extension arm, cylinder body lighting fixture 601 comprising a sixth modified or alternative embodiment of the present invention is shown in FIGS. 15 and **15*a* and is generally designated by the reference numeral 601. The lighting fixture 601 includes a mounting bracket assembly 603, which can be substantially similar to the mounting bracket assembly 4 with the addition of an adapter member 605 mounted on the end of an extension arm 607 and adapted for conforming to the configuration of a cylindrical body extension 609**.

The lighting fixture 601 includes a body 611 which can be substantially similar to the body 507 described above. The extension 609 is generally cylindrical and is mounted on the body 611. A concave reflector 613 is mounted within the body extension 609 and receives a lamp 615 threadably received in a socket 617. The lighting fixture 601 utilizes upper and lower lens mounting rings 619, 621, which can be substantially similar to the lens mounting ring 513 described above. The lens mounting ring 619 includes ring lugs 620 which extend radially inwardly and engage body rim lugs 622 in interlocking engagement. The upper lens mounting ring 619 is adapted for interconnecting the body 611 and the body extension 609, and the lower lens mounting ring 621 is adapted for mounting a circular lens 623.

X. Seventh Modified or Alternative Embodiment Lighting Fixture 701

A wall mounted, flush lighting fixture comprising a seventh modified or alternative embodiment of the present invention is shown in FIGS. 16 and 17 and is generally designated by the reference numeral 701. The lighting fixture 701 includes a mounting plate 703 with an offset, upper tab 705 and is adapted for mounting on a junction box 707 with plate-to-box mounting screws 709. The mounting plate 703 includes a pair of threaded studs 723 fixedly press-fit thereon and extending outwardly therefrom and a central opening 725 providing access to the junction box 707.

A backplate member 711 is mounted on the mounting plate 703 and has a generally semi-circular configuration with a rim 713 including an upwardly-convex arcuate portion 715 and a generally horizontal, base straight portion 717. The member 711 includes a front or outer face 719 and a rear or inner face 721. A backplate-to-mounting plate gasket 718 is compressed between the mounting plate 703 and the backplate member back face 721 around the spacer ring 731.

A rear spacer wall 727 projects rearwardly from the backplate member back face 721 and is generally parallel to the rim 713 in inwardly-spaced relation with respect thereto. The rear spacer wall 727 forms a groove 729 which is open downwardly and is adapted to receive the mounting plate upper tab 705. A spacer ring 731 projects outwardly from the back face 721, forms a shallow, circular recess 733 on the front face 719, and includes a backplate member opening 735 which aligns with the mounting plate opening 725. A pair of stud receivers 737 extend through the backplate member 711. The backplate member 711 includes reinforced sections 739 at its back face 721, which sections 739 surround the stud receivers 737.

A front spacer wall 741 projects frontwardly (outwardly) from the front face 719 generally parallel to the rim 713 in spaced relationship therefrom. The rear and front spacer walls 727, 741 have substantially similar configurations.

A perimeter flange 743 extends outwardly from the spacer walls 727, 741 to the rim 713 and has a pair of side screw receivers 745 and a top, center screw receiver 747, all of which can be countersunk at the back face 721. The perimeter flange 743 is slightly wider at the screw receiver 745, 747 locations.

A lens retainer strip 749 is provided at the rim base 717 and projects forwardly (outwardly) therefrom and has a centered drain slot or gap 750. A gasket groove 751 is formed in the front face 719 between the front spacer wall 741 and the retainer strip 749, and projects laterally therefrom into the perimeter flange 743 below the side screw receivers 745.

A pair of lower retainer lugs 753 are provided above the lens retainer strip 749, forming reflector edge channels 755 therebetween. The backplate member 711 includes component panel lugs 757 mounted in vertically spaced relation and extending forwardly from the front face 719 with three on each side of the recess 733. The backplate member 711 is secured on the mounting plate 703 by placing the mounting plate tab 705 within the groove 729 and by retaining nuts 758 placed on the studs 723.

A body 759 is mounted on the backplate member 711 by backplate-to-body screws 760 and has a configuration generally comprising a quarter of a sphere. The body 759 can be formed by bisecting a hemispherical body 507 as described above. The screws 760 extend through the screw receivers 745, 747 and into screw bosses 762 on the body 759.

A lens mounting ring 761 is attached to the body 759 in the manner described above, i.e., by locking lugs 763 and by ring-to-body mounting screws 764. The lens mounting ring 761 has a generally s®mi-circular configuration, and can comprise one-half of a bisected lens mounting ring 513 as described above. A polycarbonate lens 765 is attached to the mounting ring 761 as described above.

The lighting fixture 701 is shown with a high pressure sodium (HPS) lamp 766, but could be equipped with various other lamps, such as incandescent, fluorescent, metal halide, etc.

A socket bracket 767 is attached to an intermediate screw boss 768 by a bracket-to-boss screw 769. The socket bracket 767 mounts a lamp socket 770. The body 759 also mounts a cast heat sink 771, a capacitor 772 and a transformer 773 with an integral ignitor. These internal components can be attached by screwing into appropriate screw bosses and can be connected to the component panel lugs 757. The socket bracket 767 mounts a stud 775 with internal, female threads. A reflector 776 includes an inner edge 777 received in the reflector edge channels 755, a sloping leg 778 extending upwardly and outwardly from the inner edge 777, and a horizontal leg 779 extending outwardly from the sloping leg 778. The horizontal leg 779 is secured by a wing screw 780 threadably inserted into the female-threaded stud 775.

XI. Flush, Wall-Mounted Droop Lens Lighting Fixture 801

A flush wall-mounted droop lens lighting fixture comprising an eleventh modified or alternative embodiment of the present invention is shown in FIG. 18 and is generally designated by the reference numeral 801. The lighting fixture 801 is shown with an HPS lamp 803, but could also be equipped with a fluorescent or an incandescent lamp. A component panel 805 includes an inner edge 807 received between respective component panel lugs 809. The component panel 805 can be attached to an intermediate screw boss 811. A socket bracket 813 is attached to the component panel 805 and mounts a lamp socket 815. A reflector 817 includes an inner edge 819, an inner leg 821 extending upwardly and outwardly from the inner edge 819, and an outer leg 823 extending outwardly and downwardly from the inner leg 821. The reflector outer leg 823 is attached to the lamp socket 815.

A droop lens 825 has a flange 827 with the general configuration of a semi-circle and is attached to a lens mounting ring 829 as described above and is inserted into a lens gasket groove 831. The lens 825 includes an outwardly-and-downwardly convex face 833 with the general configuration of a quarter of a sphere, and a back or inner face 835 which is generally flat.

XII. Ninth Alternative or Modified Embodiment Lighting Fixture 901

An inside corner, quarter-circle flush wall-mounted lighting fixture comprising a ninth modified or alternative embodiment of the present invention is shown in FIG. 19 and is generally designated by the reference numeral 901. The lighting fixture 901 is adapted for placement in a corner intersection 904 of a pair of walls 905, 906. The lighting fixture 901 includes a mounting plate 902 mounted on a junction box 908. Threaded studs 910 extend inwardly from the mounting plate 902.

A backplate assembly 912 comprises a pair of backplate members 914, 916 each including a backplate member panel 918 and an inner flange 920 extending rearwardly at a dihedral angle of approximately 45° from the panel 918. Except for certain modifications such as the inner flanges which adapt the backplate members to an inside wall corner installation, the backplate members 914, 916 can include configurations and features which are substantially identical to those of the backplate member 702 described above. Each backplate member 914, 916 has a general configuration of a quarter circle. The backplate members 914, 916 can be connected together at their inner flanges 920 by an suitable fastening means, such as the rivets 922 shown and can be secured on the mounting plate 902 by retaining nuts 924 threadably received on the studs 910.

A body 926 has an outer surface 928 with the general configuration of an eighth of a sphere and can be formed, for example, by quartering a hemispherical body 507 as described above (FIG. 21). The body 926 can be attached in the manner described above, i.e, with body-to-backplate screws 930. A lens mounting ring 932 is attached to the body 926 in the manner described above, i.e., with interlocking body and lens ring lugs and with ring-to-body screws.

A suitable transparent or translucent lens 934, e.g., comprising a polycarbonate material, is attached to the lens mounting ring and to the backplate members 914, 916 and has a quarter circle configuration. However, various other lens configurations could also be employed, including a droop type lens 825 as described above. A reflector 936 is connected to the backplate assembly and extends upwardly and forwardly therefrom. A socket 938 is attached to the body 926 and receives a lamp 940 which passes through a bulb opening 942 in the reflector 936.

XIII. TENTH MODIFIED OR ALTERATIVE EMBODIMENT LIGHTING FIXTURE 1001

A flush wall-mounted, three-quarters round outside corner lighting fixture 1001 comprising a tenth modified or alternative embodiment of the present invention is shown in FIG. 20 and is generally designated by the reference numeral 1001.

The lighting fixture 1001 includes a backplate assembly 1003 comprising a pair of backplate members 1005, 1007, which can be substantially identical to the backplate members 914, 916 described above. The backplate assembly 1003 for the three-quarters round fixture 1001 can be substantially identical to the backplate 912 assembly for the quarter round fixture 901 except for a reverse orientation with backplate member inner flanges 1009 projecting outwardly from a corner edge 1011 of a pair of wall surfaces 1013, 1015. The three-quarters round lighting fixture 1001 includes a body 1017 which can be formed from a body 507 as described above by removing a quarter section (i.e., one-eighth of a sphere) therefrom. Likewise, a lens mounting ring 1019 can be formed from a lens mounting ring 513 as described above by removing approximately 90° therefrom, leaving the lens mounting ring 1019 with an annular configuration and a circumference of approximately 270°.

A lens 1021 can comprise a circle with a quarter segment removed therefrom, thus providing a circumference corresponding to the lens mounting ring 1019 and covering about 270°. The lighting fixture 1001 can be formed from many of the same components as are used for forming the lighting fixtures described above. Furthermore, such components could be cut and separated as required to form multiple lighting fixtures. For example, a hemispherical body, a circular lens mounting ring, and a circular lens could be cut to form the bodies, lens mounting rings, and lenses for a quarter circle fixture and a three-quarters circle fixture. Material waste can thus be minimized and manufacturing can be expedited by providing multiple lighting fixture configurations from standard, interchangeable components and parts.

The construction of the three-quarters fixture 1001 can be substantially similar to the construction of the one-quarter fixture 551 and the other fixtures described above, except as otherwise noted.

XIV. Eleventh Modified or Alternative Embodiment Lighting Fixture 1101

A flush wall-mounted full lens lighting fixture comprising an eleventh modified or alterative embodiment of the present invention is shown in FIG. 22 and is generally designated by the reference numeral 1101. A backplate member 1103 is attached to a junction box cover plate 1105 by studs 1107 receiving nuts 1109. A lens mounting ring assembly 1111 includes inner and outer lens mounting rings 1113, 1115 which have interlocking lugs 1114, 1116 respectively and are secured together by screws (not shown). The outer lens mounting ring 1115 can be substantially similar to the full circle lens mounting ring 98 described above, and the inner lens mounting ring 1113 can have a configuration substantially similar to the body rim 515 as described above for interlocking engagement with the outer lens mounting ring 1115. A socket mounting bracket 1117 is connected to the backplate member 1103 and mounts a socket 1119, which threadably receives a lamp 1121.

A lens 1123 has the general configuration of a hemisphere with an annular flange 1125 extending radially outwardly for attachment to an outer lens mounting ring flange 1127 which extends radially inwardly, and can be substantially similar to the lens 114 described above.

The lighting fixture 1101 can include multiple lamps. Various types of lamps can be used with the lighting fixture 1101 and with the other lighting fixtures embodying the present invention, including metal halide, mercury vapor, high pressure sodium (HPS) and low pressure sodium (LPS).

XV. Twelfth Modified or Alternative Embodiment Lighting Fixture 1201

A wall-mounted, indirect, "wall-washer" lighting fixture comprising a twelfth modified or alternative embodiment of the present invention is shown in FIG. 23 and is generally designated by the reference numeral 1201. The lighting fixture 1201 includes a facia mounting plate 1203 attached to an electrical junction box 1205 and including a sleeve 1207 for passing electrical lines 1209 therethrough. A backplate member 1211 is attached to the facia mounting plate 1203 with a gasket 1213 therebetween. A cylindrical tubular extension 1215 extends outwardly from the backplate member 1211 and mounts a support frame 1217 with an annular inner ring 1219 connected to the extension 1215 and an annular outer ring 1221. The support frame rings 1219, 1221 are interconnected by a plurality (e.g., four) of radially extending arms or spokes 1223. The extension 1215 can be extruded from aluminum and the support frame 1217 can be cast.

A lens 1225 has an annular inner flange 1227 which is connected to the support frame inner ring 1219 and an outer annular flange 1229 with a lens body 1231 extending therebetween and having the general configuration of a shallow frustum of a cone. A socket mounting bracket 1233 is connected to the lens inner flange 1227 by mounting bolts 1235 and by backplate-to-bracket screws 1237. The bolts 1235 and the screws 1237 threadably receive nuts 1239 for clamping the mounting plate 1203, the backplate member 1211, the extension 1215, the support frame 1217, the lens 1225 and the socket mounting bracket 1233 together.

A body 1241 includes a rim 1243 and can be substantially identical to the body 507 described above with a generally hemispherical configuration. A circular lens mounting ring 1245, which can be substantially similar to the lens mounting ring 513 described above, is mounted on the support frame outer ring 1221 and the body rim 1243 by bolts 1247 and is attached to the lens outer flange 1229. A ballast 1249 is attached to the socket mounting bracket 1233 and can be electrically coupled to the electric lines 1209 and a lamp 1251, which is mounted in a lamp socket 1253 which is mounted on the socket mounting bracket 1233. A rearwardly or inwardly concave reflector 1255 is mounted on inner screw bosses 1257. The reflector 1255 can be formed by a spinning process.

XVI. Thirteenth Modified or Alternative Embodiment Lighting Fixture 1301

A wall-mounted, radius bracket, gooseneck pendant lighting fixture comprising a thirteenth modified or alternative embodiment lighting fixture is shown in FIGS. 24–30 and is generally designated by the reference numeral 1301. The lighting fixture 1301 generally includes a mounting arm assembly 1303 and a luminaire assembly 1305.

The mounting arm assembly includes a wall mounting bracket subassembly 1307 (FIG. 25) with a mounting plate 1309 mounted on a junction box 1311 and receiving a cover plate 1313. An arm socket 1315 receives an inner end 1317 of a gooseneck arm 1319 and is attached to the cover plate 1313 by socket-to-cover plate screws 1321. The gooseneck arm 1319 also includes an outer end 1323 which is connected to the luminaire assembly 1305 by an outer arm socket 1325 with an outer arm socket screw 1327.

The luminaire assembly 1305 includes an upper body 1329, which can be substantially similar to the body 507 described above, except for a top center receiver 1331 which receives a threaded conduit section 1333 of the outer arm socket 1325, which is retained in place by a nut 1335. Electrical lines 1337 pass through the mounting assembly 1303.

An upper lens mounting ring 1339 is mounted on the upper body 1329. A lower body 1341 includes a bottom, centered opening 1343 and mounts a lower lens mounting ring 1345.

A louver assembly 1347 has a generally cylindrical configuration and is clamped between the lens mounting rings 1339 and 1345 by mounting ring-to-louver assembly screws 1349. The louver assembly 1347 comprises a plurality of annular bands 1351 which are clamped together in stacked relation and include cutouts 1353 between interlocking connector sections 1355. The louvre assembly 1347 can comprise different numbers of the annular bands 1351 vary the height of the fixture 1301. Furthermore, the bands 1351 can be provided with various angular slopes, e.g., relatively flat slopes of approximately 15° from the horizontal for emitting light substantially radially outwardly or with steeper slopes for the horizontal for emitting light more downwardly.

A generally cylindrical lens 1357 includes an upper flange 1359 which is attached to the upper lens mounting ring 1339. The lens 1357 also includes a lower end 1361 which is attached to an annular louver assembly adapter 1363 which interconnects the lowermost louver band 1351 and the lower lens mounting ring 1345.

A lower lens 1365 is mounted on the lower body 1341 in covering relation with respect to the lower body opening 1343. A suitable lamp (not shown) is provided in the luminaire 1305, and light therefrom is emitted through the louver assembly 1347 and the lower lens 1365.

XVII. Fourteenth Modified or Alternative Embodiment Lighting Fixture 1401

A hanging pendant skirted lighting fixture comprising a fourteenth modified or alternative embodiment of the present invention is shown in FIGS. 31–32 and is generally designated by the reference numeral 1401. The lighting fixture 1401 is suspended by a suspension conduit 1403 which carries electrical lines 1405 and is attached to a body 1407 by a conduit socket 1409, which can be substantially similar to the outer arm socket 1325 described above. The body 1407 can be substantially similar to the upper body 1329 described above.

A cylindrical, tubular body extension 1411 is mounted on the body 1407 by an upper lens mounting ring 1413. The body extension mounts a skirt 1415 with a frusto-conical configuration, which can be attached by means of a lower lens mounting ring 1417 which also mounts a lens 1419, which can have a configuration substantially similar to a lens 1123 described above. A socket 1421 is mounted within the body extension 1411 and receives a lamp 1423 which is positioned substantially within a frusto-conical reflector 1425.

XVIII. Fifteenth Modified or Alternative Embodiment Lighting Fixture 1501

A bollard, louvered lighting fixture comprising a fifteenth modified or alternative embodiment of the present invention is shown in FIGS. 33–34 and is generally designated by the reference numeral 1501. The lighting fixture 1501 includes a base 1503, which can be secured to a ground surface (e.g., pavement) 1505 by mounting screws 1507. A cylindrical body extension 1509 is mounted on the base 1503 and mounts a louver assembly 1511, which can be substantially similar to the louver assembly 1347 described above. Louver assembly connection screws 1513 extend through the louver assembly 1511 and into the body extension 1509. A lens 1515 is mounted substantially within the body extension 1509 and louver assembly 1511 by a lens mounting ring 1517, which interconnects the louver assembly 1511, the lens 1515 and a body 1519, which can be substantially similar to the body 507 described above. The configuration of the louver 1511 can be varied to adjust the height of the lighting fixture 1501 and the pattern of light emitted therefrom.

XIX. Sixteenth Modified or Alternative Embodiment Lighting Fixture 1601

A bollard, Windowed, top spot lighting fixture 1601 comprising a sixteenth modified or alternative embodiment of the present invention is shown in FIGS. 35–37 and is generally designated by the reference numeral 1601. The lighting fixture 1601 includes a base 1603, a body extension 1605 and a body 1607. A windowed body assembly 1609 is mounted between the body extension 1605 and the body 1607 and has a generally cylindrical configuration with multiple windows or cutouts 1611 separated by standards 1613 with screw bosses 1615 extending inwardly therefrom.

The windows 1611 are covered by corresponding arcuate lens panels 1617 which are held in place by lens clips 1619 mounted by lens clip screws 1621 to lens clip bosses 1623. A lamp assembly 1625 is mounted substantially within the windowed body assembly 1609 and the body 1607.

The body 1607 includes an upper opening 1627 which is covered by a lens 1629 for emitting light upwardly from the lighting fixture 1601. The body 1607 and the lens 1629 can be substantially identical to the lower body 1341 and the lower lens 1365 of the radius bracket light fixture 1301 described above.

XX. Seventeenth Modified or Alternative Embodiment Lighting Fixture 1701

A post-mounted deep lens bollard lighting fixture comprising a seventeenth modified or alternative embodiment of the present invention is shown in FIGS. 38–39 and is generally designated by the reference numeral 1701. The lighting fixture 1701 includes a base 1703 mounting a column or post 1705, which can contain electrical components (e.g., ballast, capacitors, ignitors, etc.) for a lamp assembly 1709. The column 1705 includes screw bosses 1711 which can be continuously extruded. A support assembly or basket 1713 includes a lower, annular ring 1715 mounted on the column 1705, an upper annular ring 1717 and a plurality (e.g., four) of arms or spokes 1719 interconnecting the rings 1715 and 1717. A body 1721 is mounted on the support assembly 1713 by a lens mounting ring 1723 which receives a reflector 1725.

XXI. Eighteenth Modified or Alternative Embodiment Lighting Fixture 1801

A post-mounted, flat lens down-light bollard lighting fixture comprising an eighteenth modified or alternative embodiment of the present invention is shown in FIG. 40 and is generally designated by the reference numeral 1801. The lighting fixture 1801 includes a base 1803 mounting a column 1805 which includes a lower section 1807 below a body 18 and an upper section 1809 positioned substantially within the body 1811. An annular lens 1813 is mounted on the body 1811 by a lens mounting ring 1815 and is mounted on the column 1805. The lighting fixture 1801 can include various types of lamp assemblies mounted within the body 1811 for transmitting light generally downwardly through the lens 1813.

XXII. Nineteenth Modified or Alternative Embodiment Lighting Fixture 1901

A post-mounted, skirted bollard lighting fixture comprising a nineteenth modified or alternative embodiment of the present invention is shown in FIG. 41 and is generally designated by the reference numeral 1901. The lighting fixture 1901 includes a lens 1903 with a lower body section having the general configuration of a tapered cylinder with a closed end 1905 and an annular flange 1907 extending radially outwardly therefrom and attached to a body 1909 by a lens mounting ring 1911. A reflector 1913 is mounted in the body 1909. A skirt 1915 has a generally cylindrical configuration and is mounted below the lens annular flange 1907 in a circling relationship with respect to an upper part of a column 1917. The skirt 1915 can comprise a translucent material for transmitting light received through the lens 1903.

XXIII. Twentieth Modified or Alternative Embodiment Lighting Fixture 2001

An indirect half lens bollard lighting fixture 200 comprising a twentieth modified or alternative embodiment of the present invention is shown in FIG. 42 and is generally designated by the reference numeral 2001. The lighting fixture 2001 includes a base 2003 with the general configuration of a half cylinder mounting a body 2005 at its upper end by means of a lens mounting ring 2007, which also mounts a semi-circular lens 2009 for transmitting light generally downwardly and outwardly from a suitable lamp assembly (not shown) positioned within the body 2005.

XXIV. Twenty-First Modified of Alternative Embodiment Lighting Fixture 2101

A wall-mounted, extension arm downlight lighting fixture 2101 comprising a twenty-first modified or alternative embodiment of the present invention. The lighting fixture 2101 includes a mounting bracket assembly 2103 with a generally rectangular configuration and a relatively high load capacity. The mounting bracket assembly 2103 is adapted for attachment to a wall structure 2105 with a junction box 2107 embedded therein between upper and lower structural members 2109, 2111 which can comprise, for example, channel members. The wall structure 2105 can include a panel 2113, which can comprise sheet rock gypsum board. A pair of threaded studs 2115 are secured to the structural members 2109 and 2111. The studs 2115 extend through the wall panel 2113 outwardly therefrom.

A mounting plate 2117 is secured on the studs 2115 by nuts 2119 and includes four slotted receivers 2121, each slotted receiver receiving a respective junction box mounting screw 2113. The slotted receivers 2121 allow for slight rotational adjustments of the position of the mounting plate 2117 on the junction box 2107. The mounting plate 2117 includes a tab 2125 projecting from an upper edge 2127 of the mounting plate 2117 and projecting forwardly from the mounting plate 2117 in spaced relation outwardly from the wall panel 2113. A mounting cover 2129 is installed on the mounting plate 2117 and is secured thereto by cover mounting screws 2131 which extend through countersunk receivers 2133 in the mounting cover 2129 and are threadably received in press fit, female-threaded sleeves 2135 which are mounted on the mounting plate 2117. An extension arm 2137 extends outwardly from the mounting cover 2129. The mounting plate 2117 includes a central opening 2139 which forms a passage for wiring.

XXV. Twenty-Second Modified or Alternative Embodiment Fixture 2201

An extension arm, downlight, square body lighting fixture 2201 is shown in FIG. 46 and comprises a twenty-second modified or alternative embodiment of the present invention. The external components of the lighting fixture 2201 have substantially square or rectangular configurations, including a mounting cover 2203, an extension arm 2205, a body 2207 mounted on the end of the extension arm 2205, a lens 2209, and a lens mounting ring 2211 mounting the lens 2209 on the body 2207.

XXVI. Twenty-Third Modified or Alternative Embodiment 2301

A wall-mounted, extension arm, downlight lighting fixture comprising a twenty-third modified or alternative embodiment of the present invention is shown in FIGS. 47–49. The lighting fixture 2301 includes a mounting bracket assembly 2303 with a mounting plate 2305 attached to a wall 2307. The mounting plate 2305 includes a lower flange 2309 projecting outwardly from the wall 2307 and terminating at a channel 2311 which opens upwardly. A mounting cover 2313 includes a wall 2315 and transverse, horizontal hinge pin 2317 positioned in spaced relation above the bottom wall 2315 and rotatably journaled in the channel 2311. The lighting fixture 2301 is thus hingedly mounted on the wall 2307, and can be swung downwardly to a lower position (dash lines in FIG. 48 show lower, downswung position of mounting cover 2313) for connecting electric leads 2319 during installation of the lighting fixture 2301. The mounting cover bottom wall 2315 can engage the lower flange 2309 to provide stop means for limiting the downward swinging of the lighting fixture 2301. Alternatively, the lighting fixture 2301 can include a lens 2321 which abuts the wall 2307 for limiting further downward swinging movement.

The lighting fixture 2301 includes a luminaire assembly 2323 with a body 2325 mounting the lens 2321 by means of a lens mounting ring 2327. A component mounting plate 2329 is located in the body 2325 and is mounted on intermediate screw bosses 2331. A relatively flat, circular reflector 2333 is mounted in the body 2325 in proximity to the lens mounting ring 2327 and includes a centered opening 2335 through which a lamp 2337 extends.

The mounting bracket assembly 2303 includes a body attachment bracket 2339 with a generally rectangular cross-sectional configuration (FIG. 49), in inner end 2341 with a shoulder 2343 for receiving a mounting arm extension tube 2345. The body attachment bracket 2339 includes an outer end 2347 with a complex curved configuration generally conforming to the configuration of the body 2325. The body attachment bracket 2329 is attached to the body 2325 by weldments 2349, which can be positioned Within a body attachment bore 2351 and thus concealed in the finished fixture 2301. The body attachment bracket 2339 includes bosses 2353 with threaded receivers 2355 for mounting bolts 2357 which extend through the mounting cover 2313 and into the threaded receivers 2335.

XXVII. Twenty-Fourth Modified or Alternative Embodiment Lighting Fixture 2401

A wall-mounted, wall washer lighting fixture 2401 comprising a twenty-fourth modified or alternative embodiment of the present invention is shown in FIG. 50. The lighting fixture 2401 is generally similar to the lighting fixture 1201 described above, with some different components, many of which are internal to the lighting fixture 2401. One such component is lamp assembly 2403 including a socket 2405 threadably receiving a lamp 2407. A reflector 2409 extends rearwardly and radially outwardly from the lamp 2407 and has an inner reflector 2411 which receives the socket 2405. The inner reflector 2409 can include a complex curvature designed to cooperate with the lamp 2407 and an outer reflector 2413 for optimizing the light output and distribution pattern from the lighting fixture 2401.

XXVIII. Twenty-Fifth Modified or Alternative Embodiment Lighting Fixture 2501

A post-mounted, spherical lens lighting fixture 2501 comprising a twenty-fifth modified or alternative embodiment of the present invention is shown in FIG. 51. The lighting fixture 2501 includes a base 2503 for mounting on a ground or pavement surface 2505 and a column or post 2507 with a lower end 2509 mounted on the base 2503 and an upper end 2511. A body 2513 includes a lower connecting plate 2515 which is mounted on the column upper end 2511 and an upper, annular connecting frame 2517 interconnected by a plurality of arcuate arms 2519, each forming an arc which extends through approximately 90°. In the illustrated embodiment of the lighting fixture 2501, four arms 2519 are provided at radial intervals of approximately 90°. However, other numbers of such arms at various radial intervals could be provided.

A lens 2521 is generally spherical and includes upper and lower hemispherical portions 2523, 2525 which are mounted On the body 2513 by a lens mounting ring 2527.

XXIX. Modular Lighting Method

A method of producing a line of lighting fixtures, such as the fixtures described above, involves providing interchangeable components, such as mounting bracket assemblies, bodies, illumination sources, electrical components, reflectors, lenses and lens mounting rings or frames, all as described above.

It will be appreciated that many of the components of the lighting fixtures described above are interchangeable between and among the different types of lighting fixtures. Furthermore, such components can be reconfigured in additional combinations which are not disclosed herein, but which are within the scope of the present invention. The lighting fixtures described above can be provided in various sizes. For examples, incremental sizes corresponding to the nominal lens diameters can be provided, and might include 7", 11" and 15" sizes. Of course, various other sizes and sizing increments within the lighting fixture system are also contemplated.

Efficiency and economy in manufacture are further facilitated by manufacturing components which can be dissected for providing multiple components of different fixtures. For example, FIG. 21 shows a body 507 with cut lines 508 extending generally along body channels 510 between body thickened strips 512. By dissecting the body 507 along the cut lines 508, a quarter section thereof (comprising approximately one-eighth of a sphere) can be removed to provide the body 926 for the quarter-circle, inside corner lighting fixture 901 and the body 1017 for the three-quarters circle, outside corner lighting fixture 1001. The body 507 can be bisected to provide two substantially identical bodies (e.g., body 759) for the wall-mounted, flush lighting fixtures 701 and 801.

It is to be understood that while certain forms of the present invention have been illustrated and described herein, it is not to be limited to the specific forms or arrangement of parts described and shown.

What is claimed and desired to be secured by Letters Patent is as follows:

1. A lighting fixture, which comprises:
(a) a frusto-spherical body with a concave inner surface forming an interior and a convex outer surface, said body including a rim having a curvilinear configuration, said body encompassing one or more 90 degree sectors, said body including a thickened strip along each edge of one or more of said 90 degree sectors with each said strip at least partially extending from said rim to a top portion of said body;
(b) a lens with a curvilinear edge having a configuration generally corresponding to the body rim configuration;
(c) a lens mounting ring with a curvilinear configuration corresponding to the configurations of the body rim and the lens curvilinear edge;
(d) lens mounting means for mounting said lens and said lens mounting ring on said body rim;
(e) light source means mounted in said body interior; and
(f) fixture mounting means for mounting said fixture, said fixture mounting means being connected to said body.

2. The invention of claim 1 wherein:
(a) said fixture mounting means includes junction box mounting means for mounting said fixture on an electrical junction box.

3. The invention of claim 2 wherein said fixture mounting means includes:
(a) a mounting plate; and
(b) a mounting cover placed over said mounting plate.

4. The invention of claim 3 which includes:
(a) a tab on said mounting plate; and
(b) a groove on said mounting cover adapted to receive said tab.

5. The invention of claim 3 wherein said fixture mounting means includes:
(a) a mounting arm having an inner end attached to said mounting cover and an outer end connected to said body.

6. The invention of claim 5, which includes:
(a) body-to-mounting cover screws extending through said body and said mounting arm and being threadably received in said mounting cover for mounting said body on said extension arm and said extension arm on said mounting cover.

7. The invention of claim 5, which includes:
(a) an adapter bracket mounted on said extension arm outer end and mounted on said body; and
(b) mounting cover-to-extension member mounting bolts extending through said mounting cover and said extension arm and into said adaptor block for mounting said body on said mounting arm and said mounting arm on said mounting cover.

8. The invention of claim 5 wherein said fixture mounting means includes:
(a) a radius bracket with inner and outer ends;
(b) an inner arm socket mounting said radius bracket inner end; and
(c) an outer arm socket mounted on said body and said radius bracket outer end.

9. The invention of claim 5 wherein said fixture mounting means includes:
(a) a body mounting bracket connected to said arm outer end and to said body;
(b) said body having a passage; and
(c) said body mounting bracket having a bore communicating with said body passage.

10. The invention of claim 3, which includes:
(a) a gasket positioned between said mounting plate and said mounting cover.

11. The invention of claim 10 wherein:
(a) said mounting plate and said mounting cover each includes an opening with electrical lines passing therethrough; and
(b) said gasket surrounds said openings.

12. The invention of claim 3 wherein:
(a) said mounting arm includes a knuckle bracket for rotating said body with respect to said fixture mounting means.

13. The invention of claim 2 wherein:
(a) said junction box mounting means includes a mounting plate with multiple, slotted receivers and a plurality of screws, each said screw extending through a respective slotted receiver and extending threadably into said junction box.

14. The invention of claim 1, wherein:
(a) said body includes a screw boss at said body interior, said screw boss mounting said light source means.

15. The invention of claim 14 wherein:
(a) said screw boss comprises an inner screw boss; and
(b) said body includes an outer screw boss adjacent to said rim at said body inner surface.

16. The invention of claim 12 wherein:
(a) said body includes an intermediate screw boss positioned between said inner and rim screw bosses.

17. The invention of claim 15 wherein:
(a) said light source means includes a heat sink mounted on said intermediate screw bosses.

18. The invention of claim 15 wherein:
(a) said light source means includes a reflector mounted on said intermediate screw boss within said body interior.

19. The invention of claim 15 wherein:
(a) said lens ring is mounted on said body by ring-to-body mounting screws extending through said lens ring and threadably received in said outer screw bosses.

20. The invention of claim 1, which includes:
(a) said light source means including an incandescent lamp.

21. The invention of claim 1 wherein:
(a) said light source means includes a high pressure sodium lamp.

22. The invention of claim 21 wherein:
(a) said light source means includes a ballast, a capacitor and an ignitor; and
(b) said light source means further includes a heat sink mounted in said body interior and mounting said ballast, capacitor and ignitor.

23. The invention of claim 1 wherein:
(a) said light source means includes a fluoresceent lamp.

24. The invention of claim 1 wherein:
(a) said lens mounting means includes a body lug on said body projecting from the rim thereof and a lens ring lug on said lens ring; and (b) said lugs interlocking with said lens ring mounted on said body.

25. The invention of claim 24, which includes:

(a) said body lug having a proximate leg attached to and extending from said body rim and a distal leg extending outwardly from said proximate leg, said body leg forming a channel between said distal leg and said body rim.

26. The invention of claim 25 wherein:

(a) said lens ring includes a perimeter flange with inner and outer margins and a face flange extending radially inwardly from said perimeter flange outer margin;

(b) said lens ring lug projects radially inwardly from said perimeter flange inner margin; and (c) a lens ring channel formed between said lens ring lug and said face flange for selectively receiving said body lug distal leg.

27. The invention of claim 24 wherein:

(a) said body lug is open inwardly and said ring lug is open outwardly.

28. The invention of claim 1, which includes:

(a) an O-ring groove on said body rim; and (b) an O-ring positioned partly within said O-ring groove and engaged by said lens ring.

29. The invention of claim 1, which includes:

(a) an annular O-ring groove on said lens ring;

(b) an annular bead on said body rim; and (c) an O-ring positioned at least partly within said O-ring groove and engaged by said bead.

30. The invention of claim 1, wherein:

(a) said lens has a perimeter flange and a main portion with a configuration which is convex outwardly from said body.

31. The invention of claim 1 wherein:

(a) said lens is attached to said lens mounting ring by an adhesive layer positioned therebetween.

32. The invention of claim 1 wherein:

(a) said body opens downwardly.

33. The invention of claim 32 wherein said backplate member includes:

(a) front and back faces;

(b) a rear spacer wall extending from said rear face;

(c) a front spacer wall extending from said front face; and (d) a perimeter flange extending outwardly from said front and back spacer walls.

34. The invention of claim 33, which includes:

(a) said perimeter flange having an arcuate, upper portion and a straight base portion; and (b) a lens retainer strip extending forwardly from said perimeter flange base portion in spaced relation from said front spacer wall and forming a gasket groove therebetween.

35. The invention of claim 34 wherein:

(a) said lens retainer strip includes a centered gap.

36. The invention of claim 33, which includes:

(a) said body having a female-threaded screw boss adjacent to the rim thereof;

(b) said perimeter flange having a screw receiver; and (c) a backplate member-to-body mounting screw extending through said flange receiver and into said body receiver.

37. The invention of claim 32, which includes:

(a) a retainer lug extending forwardly from said backplate member front face.

38. The invention of claim 32 wherein said body has a general configuration of three-eighths of a sphere on said backplate assembly includes a pair of backplate member joined together at a right dyhedral angle.

39. The invention of claim 38, which includes:

(a) means for mounting said backplate assembly in the inside corner of a pair of walls.

40. The invention of claim 1 wherein:

(a) said fixture mounting means includes a cover plate, means for attaching said cover plate to a wall, a mounting cover and means for attaching said mounting cover to said cover plate.

41. The invention of claim 40 wherein:

(a) said means for mounting said mounting plate on a wall comprises a threaded stud embedded in said wall and projecting outwardly therefrom, a stud receiver in said mounting plate receiving said threaded stud and a nut threadably received on said stud and retaining said mounting plate adjacent to the wall.

42. The invention of claim 41 wherein:

(a) said means for mounting said mounting cover on said mounting plate comprises a female-threaded sleeve attached to said mounting plate and a screw extending through said mounting cover and threadably received in said sleeve.

43. The invention of claim 40, which includes:

(a) hinge means hingedly interconnecting said mounting plate and said mounting cover.

44. The invention of claim 43 wherein:

(a) said hinge means includes said mounting plate having a flange extending downwardly and outwardly and forming an upwardly-open channel and a hinge pin connected to said mounted cover and rotatably journaled in said channel.

45. The invention of claim 1 wherein:

(a) said lens is substantially flat.

46. The invention of claim 1 wherein:

(a) said body opens upwardly.

47. The invention of claim 1, which includes:

(a) a generally cylindrical body extension extending outwardly from said lens mounting ring.

48. The invention of claim 47, which includes:

(a) a reflector mounted within said body extension;

(b) said body extension having an inner end mounted on said lens mounting ring and an outer end;

(c) said lens mounting ring comprising an inner lens mounting ring;

(d) an outer lens mounting ring mounted on said body extension outer end; and (e) said lens being mounted on said outer lens mounting ring.

49. The invention of claim 47, which includes:

(a) a frusto-conical skirt mounted on said cylindrical body extension.

50. The invention of claim 1 wherein:

(a) said fixture mounting means includes a backplate member and a means for mounting said backplate member on a junction box embedded in a wall.

51. The invention of claim 50 wherein:

(a) said means for mounting said backplate member on said junction box comprises a mounting plate including a mounting tab and a threaded stud fastened thereto and projecting outwardly therefrom;

(b) said backplate member having a groove receiving said tab and a receiver receiving said stud; and (c) a nut threadably received on said stud for retaining said backplate member on said mounting plate.

52. The invention of claim 50, which includes:

(a) a spacer ring extending rearwardly from said backplate rear face; and (b) a gasket surrounding said spacer ring and compressed between said mounting plate and said backplate member.

53. The invention of claim 50, wherein the body has the general configuration of a quarter of a sphere with an inner rim connected to said backplate member and an outer rim mounting said lens mounting ring.

54. The invention of claim 50, which includes:

(a) said body having the general configuration of an eighth of a sphere; and (b) first and second back plate members connected at a right dyhedral angle and forming a backplate assembly.

55. The invention of claim 50, which includes:

(a) said body having a general configuration of three-eighths of a sphere; and (b) first and second backplate members joined together at a right dyhedral angle.

56. The invention of claim 55 which includes:

(a) means for mounting said backplate assembly outside corner of a pair of walls.

57. The invention of claim 1 wherein:

(a) said body has the general configuration of a hemisphere with a central opening; and (b) a lens mounted in said opening.

58. The invention of claim 1, which includes:

(a) a body extension with louvers connected to said body.

59. The invention of claim 58, which includes:

(a) a louver assembly comprising a plurality of rings with connector sections and openings.

60. The invention of claim 59, which includes:

(a) a lens positioned within said louver assembly; and (b) said light source means being positioned at least partly within said lens.

61. The invention of claim 1 wherein said lighting fixture comprises a bollard and said fixture mounting means includes a base.

62. The invention of claim 61, which includes:

(a) a louver assembly mounted on said body and including a plurality of rings with connector sections and openings;

(b) said lens being positioned at least partly within said louver assembly; and (c) said louver assembly being connected to said body by said lens mounting ring.

63. The invention of claim 61, which includes:

(a) a column mounted on said base and extending upwardly therefrom; and (b) said body being mounted on said column.

64. The invention of claim 63, which includes:

(a) a body support assembly including a lower annular ring mounted on top of said column and an upper annular ring;

(b) said support assembly including a plurality of arms extending between and interconnecting said lower and upper annular rings;

(c) said lens mounting ring being mounted on said upper annular ring; and (d) said lens being positioned substantially within said support assembly.

65. The invention of claim 61, which includes:

(a) a generally cylindrical lower body mounted on said base and including a window opening;

(b) said lower body being attached to said lens mounting ring;

(c) said body having a top center opening;

(d) an arcuate lens panel mounted in said lower body in covering relation over said window opening; and (e) an upper lens with an upwardly convex configuration mounted in covering relation in said upper body top center opening.

66. The invention of claim 61, wherein:

(a) said base has a configuration of a half of a cylinder.

67. The invention of claim 61, which includes:

(a) said column having a lower end mounted on said base and an upper end connected to said body; and (b) generally cylindrical skirt connected to said body and surrounding said column adjacent the upper end thereof.

68. The invention of claim 1, which includes:

(a) said fixture mounting means including junction box attachment means for attaching said fixture to a junction box;

(b) generally cylindrical extension arm extending outwardly from said junction box attachment means;

(c) a support from including an inner ring connected to said extension arm and an outer ring connected to said lens mounting ring;

(d) a plurality of arms extending between and connected to said support frame inner and outer rings; and (e) said lens having a shallow, frusto-conical configuration with a central opening corresponding to the size and configuration of said inner support frame ring.

69. The invention of claim 1 wherein:

(a) said body and said lens have polygonal planar configurations.

70. The invention of claim 69, wherein:

(a) said body and said lens have generally rectangular configurations.

71. The invention of claim 70 wherein:

(a) said body and said lens have generally square planar configurations.

* * * * *